US008178037B2

(12) United States Patent
Cooper

(10) Patent No.: US 8,178,037 B2
(45) **Date of Patent: *May 15, 2012**

(54) SYSTEM FOR RELEASING GAS INTO MOLTEN METAL

(76) Inventor: Paul V. Cooper, Chesterland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/120,190

(22) Filed: May 13, 2008

(65) Prior Publication Data

US 2008/0213111 A1 Sep. 4, 2008

Related U.S. Application Data

(63) Continuation of application No. 10/773,102, filed on Feb. 4, 2004, now Pat. No. 7,402,276, which is a continuation of application No. 10/619,405, filed on Jul. 14, 2003, now Pat. No. 7,507,367, and a continuation of application No. 10/620,318, filed on Jul. 14, 2003, now Pat. No. 7,731,891.

(60) Provisional application No. 60/395,471, filed on Jul. 12, 2002.

(51) Int. Cl.
*F04B 17/00* (2006.01)

(52) U.S. Cl. ..... 266/239

(58) Field of Classification Search ..... 266/239
See application file for complete search history.

(56) References Cited

U.S. PATENT DOCUMENTS 35,604 A 6/1862 Guild
116,797 A 7/1871 Barnhart
209,219 A 10/1878 Bookwalter
251,104 A 12/1881 Finch
364,804 A 6/1887 Cole
495,760 A 4/1893 Seitz
506,572 A 10/1893 Wagener
585,188 A 6/1897 Davis
(Continued)

FOREIGN PATENT DOCUMENTS

CA 683469 3/1964
(Continued)

OTHER PUBLICATIONS

"Response to Final Office Action and Request for Continued Examination for U.S. Appl. No. 09/275,627," Including Declarations of Haynes and Johnson, Apr. 16, 2001.

(Continued)

*Primary Examiner* — Scott Kastler
(74) *Attorney, Agent, or Firm* — Snell & Wilmer L.L.P.

(57) ABSTRACT

A device for releasing gas into molten metal includes a base having a discharge. The discharge has a first section including a first cross-sectional area and a second section including a second cross-sectional area, wherein the first section is upstream of the second section and the first cross-sectional area is smaller than the second cross-sectional area. A gas-release opening is positioned so that it can release gas into one or more of the first section or the second section. As the molten metal moves from the first cross-sectional area to the second cross-sectional area gas is released into the molten metal and the molten metal flow helps to draw the gas into the flow, thereby lowering the pressure required to release gas into the molten metal. Metal-transfer conduits other than a discharge incorporated in a pump base are also disclosed, as are pumps including either a discharge or other metal-transfer conduit according to the invention.

28 Claims, 12 Drawing Sheets

U.S. PATENT DOCUMENTS

| | | | |
|---|---|---|---|
| 757,932 | A | 4/1904 | Jones |
| 882,477 | A | 3/1908 | Neumann |
| 882,478 | A | 3/1908 | Neumann |
| 890,319 | A | 6/1908 | Wells |
| 898,499 | A | 9/1908 | O'Donnell |
| 909,774 | A | 1/1909 | Flora |
| 919,194 | A | 4/1909 | Livingston |
| 1,037,659 | A | 9/1912 | Rembert |
| 1,100,475 | A | 6/1914 | Franckaerts |
| 1,196,758 | A | 9/1916 | Blair |
| 1,331,997 | A | 2/1920 | Neal |
| 1,377,101 | A | 5/1921 | Sparling |
| 1,380,798 | A | 6/1921 | Hansen et al. |
| 1,439,365 | A | 12/1922 | Hazell |
| 1,454,967 | A | 5/1923 | Gill |
| 1,470,607 | A | 10/1923 | Hazell |
| 1,513,875 | A | 11/1924 | Wilke |
| 1,518,501 | A | 12/1924 | Gill |
| 1,522,765 | A | 1/1925 | Wilke |
| 1,526,851 | A | 2/1925 | Hall |
| 1,669,668 | A | 5/1928 | Marshall |
| 1,673,594 | A | 6/1928 | Schmidt |
| 1,697,202 | A | 1/1929 | Nagle |
| 1,717,969 | A | 6/1929 | Goodner |
| 1,718,396 | A | 6/1929 | Wheeler |
| 1,896,201 | A | 2/1933 | Sterner-Rainer |
| 1,988,875 | A | 1/1935 | Saborio |
| 2,013,455 | A | 9/1935 | Baxter |
| 2,038,221 | A | 4/1936 | Kagi |
| 2,090,162 | A | 8/1937 | Tighe |
| 2,091,677 | A | 8/1937 | Fredericks |
| 2,138,814 | A | 12/1938 | Bressler |
| 2,173,377 | A | 9/1939 | Schultz, Jr. et al. |
| 2,280,979 | A | 4/1942 | Rocke |
| 2,290,961 | A | 7/1942 | Heuer |
| 2,300,688 | A | 11/1942 | Nagle |
| 2,304,849 | A | 12/1942 | Ruthman |
| 2,368,962 | A | 2/1945 | Blom |
| 2,383,424 | A | 8/1945 | Stepanoff |
| 2,423,655 | A | 7/1947 | Mars et al. |
| 2,488,447 | A | 11/1949 | Tangen et al. |
| 2,493,467 | A | 1/1950 | Sunnen |
| 2,515,097 | A | 7/1950 | Schryber |
| 2,515,478 | A | 7/1950 | Tooley et al. |
| 2,528,208 | A | 10/1950 | Bonsack et al. |
| 2,528,210 | A | 10/1950 | Stewart |
| 2,543,633 | A | 2/1951 | Lamphere |
| 2,566,892 | A | 9/1951 | Jacobs |
| 2,625,720 | A | 1/1953 | Ross |
| 2,626,086 | A | 1/1953 | Forrest |
| 2,676,279 | A | 4/1954 | Wilson |
| 2,677,609 | A | 5/1954 | Moore et al. |
| 2,698,583 | A | 1/1955 | House et al. |
| 2,714,354 | A | 8/1955 | Farrand |
| 2,762,095 | A | 9/1956 | Pemetzrieder |
| 2,768,587 | A | 10/1956 | Corneil |
| 2,775,348 | A | 12/1956 | Williams |
| 2,779,574 | A | 1/1957 | Schneider |
| 2,787,873 | A | 4/1957 | Hadley |
| 2,808,782 | A | 10/1957 | Thompson et al. |
| 2,809,107 | A | 10/1957 | Russell |
| 2,821,472 | A | 1/1958 | Peterson et al. |
| 2,824,520 | A | 2/1958 | Bartels |
| 2,832,292 | A | 4/1958 | Edwards |
| 2,853,019 | A | 9/1958 | Thorton |
| 2,865,618 | A | 12/1958 | Abell |
| 2,901,677 | A | 8/1959 | Chessman et al. |
| 2,906,632 | A | 9/1959 | Nickerson |
| 2,918,876 | A | 12/1959 | Howe |
| 2,948,524 | A | 8/1960 | Sweeney et al. |
| 2,958,293 | A | 11/1960 | Pray, Jr. |
| 2,978,885 | A | 4/1961 | Davison |
| 2,984,524 | A | 5/1961 | Franzen |
| 2,987,885 | A | 6/1961 | Hodge |
| 3,010,402 | A | 11/1961 | King |
| 3,015,190 | A | 1/1962 | Arbeit |
| 3,039,864 | A | 6/1962 | Hess |
| 3,044,408 | A | 7/1962 | Mellott |
| 3,048,384 | A | 8/1962 | Sweeney et al. |
| 3,070,393 | A | 12/1962 | Silverberg et al. |
| 3,092,030 | A | 6/1963 | Wunder |
| 3,130,678 | A | 4/1964 | Chenault |
| 3,130,679 | A | 4/1964 | Sence |
| 3,171,357 | A | 3/1965 | Egger |
| 3,203,182 | A | 8/1965 | Pohl |
| 3,227,547 | A | 1/1966 | Szekely |
| 3,244,109 | A | 4/1966 | Barske |
| 3,251,676 | A | 5/1966 | Johnson |
| 3,255,702 | A | 6/1966 | Gehrm |
| 3,258,283 | A | 6/1966 | Winberg et al. |
| 3,272,619 | A | 9/1966 | Sweeney et al. |
| 3,289,473 | A | 12/1966 | Louda |
| 3,289,743 | A | 12/1966 | Louda |
| 3,291,473 | A | 12/1966 | Sweeney et al. |
| 3,374,943 | A | 3/1968 | Cervenka |
| 3,400,923 | A | 9/1968 | Howie et al. |
| 3,417,929 | A | 12/1968 | Secrest et al. |
| 3,432,336 | A | 3/1969 | Langrod |
| 3,459,133 | A | 8/1969 | Scheffler |
| 3,459,346 | A | 8/1969 | Tinnes |
| 3,477,383 | A | 11/1969 | Rawson et al. |
| 3,487,805 | A | 1/1970 | Satterthwaite |
| 1,185,314 | A | 3/1970 | London |
| 3,512,762 | A | 5/1970 | Umbricht |
| 3,512,788 | A | 5/1970 | Kilbane |
| 3,561,885 | A | 2/1971 | Lake |
| 3,575,525 | A | 4/1971 | Fox et al. |
| 3,618,917 | A | 11/1971 | Fredrikson |
| 3,620,716 | A | 11/1971 | Hess |
| 3,650,730 | A | 3/1972 | Derham et al. |
| 3,689,048 | A | 9/1972 | Foulard et al. |
| 3,715,112 | A | 2/1973 | Carbonnel |
| 3,732,032 | A | 5/1973 | Daneel |
| 3,737,304 | A | 6/1973 | Blayden |
| 3,737,305 | A | 6/1973 | Blayden et al. |
| 3,743,263 | A | 7/1973 | Szekely |
| 3,743,500 | A | 7/1973 | Foulard et al. |
| 3,753,690 | A | 8/1973 | Emley et al. |
| 3,759,628 | A | 9/1973 | Kempf |
| 3,759,635 | A | 9/1973 | Carter et al. |
| 3,767,382 | A | 10/1973 | Bruno et al. |
| 3,776,660 | A | 12/1973 | Anderson et al. |
| 3,785,632 | A | 1/1974 | Kraemer et al. |
| 3,787,143 | A | 1/1974 | Carbonnel et al. |
| 3,799,522 | A | 3/1974 | Brant et al. |
| 3,799,523 | A | 3/1974 | Seki |
| 3,807,708 | A | 4/1974 | Jones |
| 3,814,400 | A | 6/1974 | Seki |
| 3,824,028 | A | 7/1974 | Zenkner et al. |
| 3,824,042 | A | 7/1974 | Barnes et al. |
| 3,836,280 | A | 9/1974 | Koch |
| 3,839,019 | A | 10/1974 | Bruno et al. |
| 3,844,972 | A | 10/1974 | Tully, Jr. et al. |
| 3,871,872 | A | 3/1975 | Downing et al. |
| 3,873,073 | A | 3/1975 | Baum et al. |
| 3,873,305 | A | 3/1975 | Claxton et al. |
| 3,881,039 | A | 4/1975 | Baldieri et al. |
| 3,886,992 | A | 6/1975 | Maas et al. |
| 3,915,594 | A | 10/1975 | Nesseth |
| 3,915,694 | A | 10/1975 | Ando |
| 3,941,588 | A | 3/1976 | Dremann |
| 3,941,589 | A | 3/1976 | Norman et al. |
| 3,954,134 | A | 5/1976 | Maas et al. |
| 3,958,979 | A | 5/1976 | Valdo |
| 3,958,981 | A | 5/1976 | Forberg et al. |
| 3,961,778 | A | 6/1976 | Carbonnel et al. |
| 3,966,456 | A | 6/1976 | Ellenbaum et al. |
| 3,967,286 | A | 6/1976 | Andersson et al. |
| 3,972,709 | A | 8/1976 | Chin et al. |
| 3,984,234 | A | 10/1976 | Claxton et al. |
| 3,985,000 | A | 10/1976 | Hartz |
| 3,997,336 | A | 12/1976 | van Linden et al. |
| 4,003,560 | A | 1/1977 | Carbonnel |
| 4,008,884 | A | 2/1977 | Fitzpatrick et al. |
| 4,018,598 | A | 4/1977 | Markus |
| 4,052,199 | A | 10/1977 | Mangalick |
| 4,055,390 | A | 10/1977 | Young |

4,063,849 A 12/1977 Modianos
4,068,965 A 1/1978 Lichti
4,091,970 A 5/1978 Komiyama et al.
4,119,141 A 10/1978 Thut et al.
4,126,360 A 11/1978 Miller et al.
4,128,415 A 12/1978 van Linden et al.
4,144,562 A 3/1979 Cooper
4,169,584 A 10/1979 Mangalick
4,191,486 A 3/1980 Pelton
4,192,011 A 3/1980 Cooper et al.
4,213,091 A 7/1980 Cooper
4,213,176 A 7/1980 Cooper
4,213,742 A 7/1980 Henshaw
4,219,882 A 8/1980 Cooper et al.
4,242,039 A 12/1980 Villard et al.
4,244,423 A 1/1981 Thut et al.
4,286,985 A 9/1981 Van Linden et al.
4,305,214 A 12/1981 Hurst
4,322,245 A 3/1982 Claxton
4,338,062 A 7/1982 Neal
4,347,041 A 8/1982 Cooper
4,351,514 A 9/1982 Koch
4,355,789 A 10/1982 Dolzhenkov et al.
4,360,314 A 11/1982 Pennell
4,370,096 A 1/1983 Church
4,372,541 A 2/1983 Bocourt et al.
4,375,937 A 3/1983 Cooper
4,389,159 A 6/1983 Sarvanne
4,392,888 A 7/1983 Eckert et al.
4,410,299 A 10/1983 Shimoyama
4,419,049 A 12/1983 Gerboth et al.
4,456,424 A 6/1984 Araoka
4,456,974 A 6/1984 Cooper
4,470,846 A 9/1984 Dube
4,474,315 A 10/1984 Gilbert et al.
4,489,475 A 12/1984 Struttmann
4,496,393 A 1/1985 Lustenberger
4,504,392 A 3/1985 Groteke
4,537,624 A 8/1985 Tenhover et al.
4,537,625 A 8/1985 Tenhover et al.
4,556,419 A 12/1985 Otsuka et al.
4,557,766 A 12/1985 Tenhover et al.
4,586,845 A 5/1986 Morris
4,592,700 A 6/1986 Toguchi et al.
4,593,597 A 6/1986 Albrecht et al.
4,594,052 A 6/1986 Niskanen
4,598,899 A 7/1986 Cooper
4,600,222 A 7/1986 Appling
4,607,825 A 8/1986 Briolle et al.
4,609,442 A 9/1986 Tenhover et al.
4,611,790 A 9/1986 Otsuka et al.
4,617,232 A 10/1986 Chandler et al.
4,634,105 A 1/1987 Withers et al.
4,640,666 A 2/1987 Sodergard
4,651,806 A 3/1987 Allen et al.
4,655,610 A 4/1987 Al-Jaroudi
4,684,281 A 8/1987 Patterson
4,685,822 A 8/1987 Pelton
4,696,703 A 9/1987 Henderson et al.
4,701,226 A 10/1987 Henderson et al.
4,714,371 A 12/1987 Cuse
4,717,540 A 1/1988 McRae et al.
4,739,974 A 4/1988 Mordue
4,743,428 A 5/1988 McRae et al.
4,747,583 A 5/1988 Gordon et al.
4,767,230 A 8/1988 Leas, Jr.
4,770,701 A 9/1988 Henderson et al.
390,319 A 10/1988 Thomson
4,786,230 A 11/1988 Thut
4,802,656 A 2/1989 Hudault et al.
4,804,168 A 2/1989 Otsuka et al.
4,810,314 A 3/1989 Henderson et al.
4,834,573 A 5/1989 Asano et al.
4,842,227 A 6/1989 Harrington et al.
4,844,425 A 7/1989 Piras et al.
4,851,296 A 7/1989 Tenhover et al.
4,859,413 A 8/1989 Harris et al.
4,867,638 A 9/1989 Handtmann et al.
4,884,786 A 12/1989 Gillespie
4,898,367 A 2/1990 Cooper
4,908,060 A 3/1990 Duenkelmann
4,923,770 A 5/1990 Grasselli et al.
4,930,986 A 6/1990 Cooper
4,931,091 A 6/1990 Waite et al.
4,940,214 A 7/1990 Gillespie
4,940,384 A 7/1990 Amra et al.
4,954,167 A 9/1990 Cooper
4,973,433 A 11/1990 Gilbert et al.
4,986,736 A 1/1991 Kajiwara et al.
4,989,736 A 2/1991 Andersson et al.
5,006,232 A 4/1991 Lidgitt et al.
5,025,198 A 6/1991 Mordue et al.
5,028,211 A 7/1991 Mordue et al.
5,029,821 A 7/1991 Bar-on et al.
5,049,841 A 9/1991 Cooper et al.
5,078,572 A 1/1992 Amra et al.
5,080,715 A 1/1992 Provencher et al.
5,088,893 A 2/1992 Gilbert et al.
5,092,821 A 3/1992 Gilbert et al.
5,098,134 A 3/1992 Monckton
5,099,554 A 3/1992 Cooper
5,114,312 A 5/1992 Stanislao
5,126,047 A 6/1992 Martin et al.
5,131,632 A 7/1992 Olson
5,143,357 A 9/1992 Gilbert et al.
5,145,322 A 9/1992 Senior, Jr. et al.
5,152,631 A 10/1992 Bauer
5,154,652 A 10/1992 Ecklesdafer
5,158,440 A 10/1992 Cooper et al.
5,162,858 A 11/1992 Shoji et al.
5,165,858 A 11/1992 Gilbert et al.
5,172,458 A 12/1992 Cooper
5,177,304 A 1/1993 Nagel
5,191,154 A 3/1993 Nagel
5,192,193 A 3/1993 Cooper et al.
5,202,100 A 4/1993 Nagel et al.
5,203,681 A 4/1993 Cooper
5,209,641 A 5/1993 Hoglund et al.
5,215,448 A 6/1993 Cooper
5,268,020 A 12/1993 Claxton
5,286,163 A 2/1994 Amra et al.
5,298,233 A 3/1994 Nagel
5,301,620 A 4/1994 Nagel et al.
5,308,045 A 5/1994 Cooper
5,310,412 A 5/1994 Gilbert et al.
5,318,360 A 6/1994 Langer et al.
5,322,547 A 6/1994 Nagel et al.
5,324,341 A 6/1994 Nagel et al.
5,330,328 A * 7/1994 Cooper ..... 417/424.1
5,354,940 A 10/1994 Nagel
5,358,549 A 10/1994 Nagel et al.
5,358,697 A 10/1994 Nagel
5,364,078 A 11/1994 Pelton
5,369,063 A 11/1994 Gee et al.
5,383,651 A 1/1995 Blasen et al.
5,388,633 A 2/1995 Mercer, II et al.
5,395,405 A 3/1995 Nagel et al.
5,399,074 A 3/1995 Nose et al.
5,407,294 A 4/1995 Giannini
5,411,240 A 5/1995 Rapp et al.
5,425,410 A 6/1995 Reynolds
5,431,551 A 7/1995 Aquino et al.
5,435,982 A 7/1995 Wilkinson
5,436,210 A 7/1995 Wilkinson et al.
5,443,572 A 8/1995 Wilkinson et al.
5,454,423 A 10/1995 Tsuchida et al.
5,468,280 A 11/1995 Areaux
5,470,201 A 11/1995 Gilbert et al.
5,484,265 A 1/1996 Horvath et al.
5,489,734 A 2/1996 Nagel et al.
5,491,279 A 2/1996 Robert et al.
5,495,746 A 3/1996 Sigworth
5,505,143 A 4/1996 Nagel
5,509,791 A 4/1996 Turner
5,537,940 A 7/1996 Nagel et al.
5,543,558 A 8/1996 Nagel et al.
5,555,822 A 9/1996 Loewen et al.
5,558,501 A 9/1996 Wang et al.

| | | | | |
|---|---|---|---|---|
| 5,558,505 | A | 9/1996 | Mordue et al. | |
| 5,571,486 | A | 11/1996 | Robert et al. | |
| 5,585,532 | A | 12/1996 | Nagel | |
| 5,586,863 | A | 12/1996 | Gilbert et al. | |
| 5,591,243 | A | 1/1997 | Colussi et al. | |
| 5,597,289 | A | 1/1997 | Thut | |
| 5,613,245 | A | 3/1997 | Robert | |
| 5,616,167 | A | 4/1997 | Eckert | |
| 5,622,481 | A | 4/1997 | Thut | |
| 5,629,464 | A | 5/1997 | Bach et al. | |
| 5,634,770 | A | 6/1997 | Gilbert et al. | |
| 5,640,706 | A | 6/1997 | Nagel et al. | |
| 5,640,707 | A | 6/1997 | Nagel et al. | |
| 5,640,709 | A | 6/1997 | Nagel et al. | |
| 5,655,849 | A | 8/1997 | McEwen et al. | |
| 5,662,725 | A | 9/1997 | Cooper | |
| 5,676,520 | A | 10/1997 | Thut | |
| 5,678,244 | A | 10/1997 | Shaw et al. | |
| 5,678,807 | A | 10/1997 | Cooper | |
| 5,679,132 | A | 10/1997 | Rauenzahn et al. | |
| 5,685,701 | A | 11/1997 | Chandler et al. | |
| 5,690,888 | A | 11/1997 | Robert | |
| 5,695,732 | A | 12/1997 | Sparks et al. | |
| 5,716,195 | A | 2/1998 | Thut | |
| 5,717,149 | A | 2/1998 | Nagel et al. | |
| 5,718,416 | A | 2/1998 | Flisakowski et al. | |
| 5,735,668 | A | 4/1998 | Klein | |
| 5,735,935 | A | 4/1998 | Areaux | |
| 5,741,422 | A | 4/1998 | Eichenmiller et al. | |
| 5,744,117 | A | 4/1998 | Wilkinson et al. | |
| 5,745,861 | A | 4/1998 | Bell et al. | |
| 5,755,847 | A | 5/1998 | Quayle | |
| 5,772,324 | A | 6/1998 | Falk | |
| 5,776,420 | A | 7/1998 | Nagel | |
| 5,785,494 | A | 7/1998 | Vild et al. | |
| 5,805,067 | A | 9/1998 | Bradley et al. | |
| 5,810,311 | A | 9/1998 | Davison et al. | |
| 5,842,832 | A | 12/1998 | Thut | |
| 5,858,059 | A | 1/1999 | Abramovich et al. | |
| 5,863,314 | A | 1/1999 | Morando | |
| 5,864,316 | A | 1/1999 | Bradley et al. | |
| 5,866,095 | A | 2/1999 | McGeever et al. | |
| 5,875,385 | A | 2/1999 | Stephenson et al. | |
| 5,935,528 | A | 8/1999 | Stephenson et al. | |
| 5,944,496 | A | 8/1999 | Cooper | |
| 5,947,705 | A | 9/1999 | Mordue et al. | |
| 5,949,369 | A | 9/1999 | Bradley et al. | |
| 5,951,243 | A | 9/1999 | Cooper | |
| 5,961,285 | A | 10/1999 | Meneice et al. | |
| 5,992,230 | A | 11/1999 | Scarpa et al. | |
| 5,993,726 | A | 11/1999 | Huang | |
| 5,993,728 | A | 11/1999 | Vild | |
| 5,995,041 | A | 11/1999 | Bradley et al. | |
| 6,019,576 | A | 2/2000 | Thut | |
| 6,024,286 | A | 2/2000 | Bradley et al. | |
| 6,027,685 | A | 2/2000 | Cooper | |
| 6,036,745 | A | 3/2000 | Gilbert et al. | |
| 6,074,455 | A | 6/2000 | van Linden et al. | |
| 6,093,000 | A | 7/2000 | Cooper | |
| 6,096,109 | A | 8/2000 | Nagel et al. | |
| 6,113,154 | A | 9/2000 | Thut | |
| 6,123,523 | A * | 9/2000 | Cooper | 417/424.1 |
| 6,152,691 | A | 11/2000 | Thut | |
| 6,168,753 | B1 | 1/2001 | Morando | |
| 6,187,096 | B1 | 2/2001 | Thut | |
| 6,217,823 | B1 | 4/2001 | Vild et al. | |
| 6,231,639 | B1 | 5/2001 | Eichenmiller et al. | |
| 6,243,366 | B1 | 6/2001 | Bradley et al. | |
| 6,250,881 | B1 | 6/2001 | Mordue et al. | |
| 6,254,340 | B1 | 7/2001 | Vild et al. | |
| 6,270,717 | B1 | 8/2001 | Tremblay et al. | |
| 6,280,157 | B1 | 8/2001 | Cooper | |
| 6,293,759 | B1 | 9/2001 | Thut | |
| 6,303,074 | B1 | 10/2001 | Cooper | |
| 6,345,964 | B1 | 2/2002 | Cooper | |
| 6,354,796 | B1 | 3/2002 | Morando | |
| 6,358,467 | B1 | 3/2002 | Mordue | |
| 6,371,723 | B1 | 4/2002 | Grant et al. | |
| 6,398,525 | B1 | 6/2002 | Cooper | |
| 6,439,860 | B1 | 8/2002 | Greer | |
| 6,451,247 | B1 | 9/2002 | Mordue et al. | |
| 6,457,940 | B1 | 10/2002 | Lehman | |
| 6,457,950 | B1 | 10/2002 | Cooper et al. | |
| 6,464,458 | B2 | 10/2002 | Vild | |
| 6,495,948 | B1 | 12/2002 | Garrett, III | |
| 6,497,559 | B1 | 12/2002 | Grant | |
| 6,503,292 | B2 | 1/2003 | Klingensmith et al. | |
| 6,524,066 | B2 | 2/2003 | Thut | |
| 6,533,535 | B2 | 3/2003 | Thut | |
| 6,551,060 | B2 | 4/2003 | Mordue et al. | |
| 6,562,286 | B1 | 5/2003 | Lehman | |
| 6,648,026 | B2 | 11/2003 | Look et al. | |
| 6,679,936 | B2 | 1/2004 | Quackenbush | |
| 6,689,310 | B1 | 2/2004 | Cooper | |
| 6,695,510 | B1 | 2/2004 | Look et al. | |
| 6,709,234 | B2 | 3/2004 | Gilbert et al. | |
| 6,716,147 | B1 | 4/2004 | Hinkle et al. | |
| 6,723,276 | B1 | 4/2004 | Cooper | |
| 6,805,834 | B2 | 10/2004 | Thut | |
| 6,843,640 | B2 | 1/2005 | Mordue et al. | |
| 6,848,497 | B2 | 2/2005 | Sale et al. | |
| 6,869,564 | B2 | 3/2005 | Gilbert et al. | |
| 6,881,030 | B2 | 4/2005 | Thut | |
| 6,887,424 | B2 | 5/2005 | Ohno et al. | |
| 6,887,425 | B2 | 5/2005 | Mordue et al. | |
| 6,896,271 | B2 | 5/2005 | Uchida et al. | |
| 6,902,696 | B2 | 6/2005 | Klingensmith et al. | |
| 6,955,489 | B2 | 10/2005 | Look et al. | |
| 7,056,322 | B2 | 6/2006 | Davison et al. | |
| 7,083,758 | B2 | 8/2006 | Tremblay | |
| 7,131,482 | B2 | 11/2006 | Vincent et al. | |
| 7,157,043 | B2 | 1/2007 | Neff | |
| 7,279,128 | B2 | 10/2007 | Kennedy et al. | |
| 7,326,028 | B2 | 2/2008 | Morando | |
| 7,402,276 | B2 | 7/2008 | Cooper | |
| 7,470,392 | B2 * | 12/2008 | Cooper | 266/239 |
| 7,476,357 | B2 | 1/2009 | Thut | |
| 7,497,988 | B2 | 3/2009 | Thut | |
| 7,507,367 | B2 | 3/2009 | Cooper | |
| 2001/0000465 | A1 | 4/2001 | Thut | |
| 2001/0012758 | A1 | 8/2001 | Bradley et al. | |
| 2002/0185794 | A1 | 12/2002 | Vincent | |
| 2002/0187947 | A1 | 12/2002 | Jarai et al. | |
| 2003/0047850 | A1 | 3/2003 | Areaux | |
| 2004/0076533 | A1 | 4/2004 | Cooper | |
| 2004/0115079 | A1 | 6/2004 | Cooper | |
| 2004/0199435 | A1 | 10/2004 | Abrams et al. | |
| 2004/0262825 | A1 | 12/2004 | Cooper | |
| 2005/0013713 | A1 | 1/2005 | Cooper | |
| 2005/0013714 | A1 | 1/2005 | Cooper | |
| 2005/0013715 | A1 | 1/2005 | Cooper | |
| 2005/0053499 | A1 | 3/2005 | Cooper | |
| 2005/0077730 | A1 | 4/2005 | Thut | |
| 2005/0081607 | A1 | 4/2005 | Patel et al. | |
| 2005/0116398 | A1 | 6/2005 | Tremblay | |
| 2006/0180963 | A1 | 8/2006 | Thut | |
| 2007/0253807 | A1 | 11/2007 | Cooper | |

FOREIGN PATENT DOCUMENTS

| | | | |
|---|---|---|---|
| CA | 2115929 | | 8/1992 |
| CA | 2176475 | | 5/1996 |
| CA | 2244251 | | 12/1996 |
| CA | 2305865 | | 2/2000 |
| CH | 392268 | | 9/1965 |
| DE | 1800446 | | 12/1969 |
| EP | 0168250 | A2 | 1/1986 |
| EP | 0665378 | | 2/1995 |
| EP | 1019635 | | 6/2006 |
| GB | 942648 | | 11/1963 |
| GB | 1185314 | | 3/1970 |
| GB | 2217784 | | 3/1989 |
| JP | 58048796 | | 3/1983 |
| JP | 63104773 | | 5/1988 |
| MX | 227385 | | 4/2005 |
| NO | 90756 | | 1/1959 |
| RU | 416401 | | 2/1974 |
| RU | 773312 | | 10/1980 |

| | | |
|---|---|---|
| WO | WO9808990 | 3/1998 |
| WO | WO9825031 | 6/1998 |
| WO | 0212147 | 2/2002 |

OTHER PUBLICATIONS

Document No. 504217: Excerpts from "Pyrotek Inc.'s Motion for Summary Judgment of Invalidity and Unenforceability of U.S. Patent No. 7,402,276," Oct. 2, 2009.
Document No. 505026: Excerpts from "MMEI's Response to Pyrotek's Motion for Summary Judgment of Invalidity or Enforceability of U.S. Patent No. 7,402,276," Oct. 9, 2009.
Document No. 507689: Excerpts from "MMEI's Pre-Hearing Brief and Supplemental Motion for Summary Judgment of Infringement of Claims 3-4, 15, 17-20, 26 and 28-29 of the '074 Patent and Motion for Reconsideration of the Validity of Claims 7-9 of the '276 Patent," Nov. 4, 2009.
Document No. 517158: Excerpts from "Reasoned Award," Feb. 19, 2010.
Document No. 525055: Excerpts from "Molten Metal Equipment Innovations, Inc.'s Reply Brief in Support of Application to Confirm Arbitration Award and Opposition to Motion to Vacate," May 12, 2010.
USPTO; Office Action dated Mar. 16, 2005 in U.S. Appl. No. 10/827,941.
USPTO; Final Office Action dated Nov. 7, 2005 in U.S. Appl. No. 10/827,941.
USPTO; Office Action dated Jul. 12, 2006 in U.S. Appl. No. 10/827,941.
USPTO; Final Office Action dated Mar. 8, 2007 in U.S. Appl. No. 10/827,941.
USPTO; Office Action dated Oct. 29, 2007 in U.S. Appl. No. 10/827,941.
USPTO; Office Action dated Nov. 15, 2007 in U.S. Appl. No. 10/773,101.
USPTO; Office Action dated Sep. 26, 2008 in U.S. Appl. No. 11/413,982.
USPTO; Final Office Action dated Oct. 14, 2008 in U.S. Appl. No. 12/111,835.
USPTO; Office Action dated May 15, 2009 in U.S. Appl. No. 12/111,835.
USPTO; Office Action dated Nov. 3, 2008 in U.S. Appl. No. 12/120,200.
USPTO; Final Office Action dated May 28, 2009 in U.S. Appl. No. 12/120,200.
USPTO; Office Action dated Dec. 18, 2009 in U.S. Appl. No. 12/120,200.
USPTO; Final Office Action dated Jul. 9, 2010 in U.S. Appl. No. 12/120,200.
USPTO; Office Action dated Jan. 21, 2011 in U.S. Appl. No. 12/120,200.
USPTO; Final Office Action dated Jul. 26, 2011 in U.S. Appl. No. 12/120,200.
USPTO; Office Action dated Apr. 13, 2009 in U.S. Appl. No. 12/264,416.
USPTO; Final Office Action dated Oct. 8, 2009 in U.S. Appl. No. 12/264,416.
USPTO; Office Action dated Feb. 1, 2010 in U.S. Appl. No. 12/264,416.
USPTO; Final Office Action dated Jun. 30, 2010 in U.S. Appl. No. 12/264,416.
USPTO; Office Action dated Mar. 17, 2011 in U.S. Appl. No. 12/264,416.
USPTO; Final Office Action dated Jul. 7, 2011 in U.S. Appl. No. 12/264,416.
USPTO; Office Action dated Nov. 4, 2011 in U.S. Appl. No. 12/264,416.
USPTO; Office Action dated Apr. 27, 2009 in U.S. Appl. No. 12/146,788.
USPTO; Final Office Action dated Oct. 15, 2009 in U.S. Appl. No. 12/146,788.
USPTO; Office Action dated Feb. 16, 2010 in U.S. Appl. No. 12/146,788.
USPTO; Final Office Action dated Jul. 13, 2010 in U.S. Appl. No. 12/146,788.
USPTO; Office Action dated Apr. 19, 2011 in U.S. Appl. No. 12/146,788.
USPTO; Notice of Allowance dated Aug. 19, 2011 in U.S. Appl. No. 12/146,788.
USPTO; Office Action dated May 22, 2009 in U.S. Appl. No. 12/369,362.
USPTO; Final Office Action dated Dec. 14, 2009 in U.S. Appl. No. 12/369,362.
USPTO; Office Action dated Jun. 16, 2009 in U.S. Appl. No. 12/146,770.
USPTO; Final Office Action dated Feb. 24, 2010 in U.S. Appl. No. 12/146,770.
USPTO; Office Action dated Jun. 9, 2010 in U.S. Appl. No. 12/146,770.
USPTO; Office Action dated Nov. 18, 2010 in U.S. Appl. No. 12/146,770.
USPTO; Final Office Action dated Apr. 4, 2011 in U.S. Appl. No. 12/146,770.
USPTO; Notice of Allowance dated Aug. 22, 2011 in U.S. Appl. No. 12/146,770.
USPTO; Notice of Allowance dated Nov. 1, 2011 in U.S. Appl. No. 12/146,770.
USPTO; Office Action dated Dec. 11, 2009 in U.S. Appl. No. 11/766,617.
USPTO; Office Action dated Mar. 8, 2010 in U.S. Appl. No. 11/766,617.
USPTO; Final Office Action dated Sep. 20, 2010 in U.S. Appl. No. 11/766,617.
USPTO; Office Action dated Mar. 1, 2011 in U.S. Appl. No. 11/766,617.
USPTO; Office Action dated Sep. 22, 2011 in U.S. Appl. No. 11/766,617.
USPTO; Final Office Action dated Jun. 11, 2010 in U.S. Appl. No. 12/395,430.
USPTO; Office Action dated Nov. 24, 2010 in U.S. Appl. No. 12/395,430.
USPTO; Final Office Action dated Apr. 6, 2011 in U.S. Appl. No. 12/395,430.
USPTO; Office Action dated Aug. 18, 2011 in U.S. Appl. No. 12/395,430.
USPTO; Office Action dated Dec. 13, 2011 in U.S. Appl. No. 12/395,430.
USPTO; Office Action dated Sep. 29, 2010 in U.S. Appl. No. 12/758,509.
USPTO; Final Office Action dated May 11, 2011 in U.S. Appl. No. 12/758,509.
USPTO; Office Action dated Sep. 29, 2011 in U.S. Appl. No. 12/880,027.
USPTO; Office Action dated Aug. 25, 2011 in U.S. Appl. No. 13/047,747.
USPTO; Office Action dated Aug. 25, 2011 in U.S. Appl. No. 13/047,719.
USPTO; Final Office Action dated Dec. 16, 2011 in U.S. Appl. No. 13/047,719.
USPTO; Notice of Reissue Examination Certificate dated Aug. 27, 2001 in U.S. Appl. No. 90/005,910.
CIPO; Office Action dated Dec. 4, 2001 in Application No. 2,115,929.
CIPO; Office Action dated Apr. 22, 2002 in Application No. 2,115,929.
CIPO; Notice of Allowance dated Jul. 18, 2003 in Application No. 2,115,929.
CIPO; Office Action dated Jun. 30, 2003 in Application No. 2,176,475.
CIPO; Notice of Allowance dated Sep. 15, 2004 in Application No. 2,176,475.
CIPO; Office Action dated May 29, 2000 in Application No. 2,242,174.
CIPO; Office Action dated Feb. 22, 2006 in Application No. 2,244,251.

CIPO; Office Action dated Mar. 27, 2007 in Application No. 2,244,251.
CIPO; Notice of Allowance dated Jan. 15, 200 in Application No. 2,244,251.
CIPO; Office Action dated Sep. 18, 2002 in Application No. 2,305,865.
CIPO; Notice of Allowance dated May 2, 2003 in Application No. 2,305,865.
EPO; Examination Report dated Oct. 6, 2008 in Application No. 08158682.
EPO; Office Action dated Jan. 26, 2010 in Application No. 08158682.
EPO; Office Action dated Feb. 15, 2011 in Application No. 08158682.
EPO; Search Report dated Nov. 9, 1998 in Application No. 98112356.
EPO; Office Action dated Feb. 6, 2003 in Application No. 99941032.
PCT; International Search Report or Declaration dated Nov. 15, 1999 in Application No. PCT/US1999/18178.
PCT; International Search Report or Declaration dated Oct. 9, 1998 in Application No. PCT/US1999/22440.

* cited by examiner

SYSTEM FOR RELEASING GAS INTO MOLTEN METAL

RELATED APPLICATIONS

This application is a continuation of and claims priority to U.S. application Ser. No. 10/773,102 filed Feb. 4, 2004 (now U.S. Pat. No. 7,402,276, issued Jul. 22, 2008), which is a continuation of and claims priority to U.S. application Ser. No. 10/619,405 filed Jul. 14, 2003 (now U.S. Pat. No. 7,507, 367, issued Mar. 24, 2009) and U.S. application Ser. No. 10/620,318 filed Jul. 14, 2003 (now U.S. Pat. No. 7,731,891 issued Jun. 8, 2010), both of which claim priority to U.S. Provisional Patent Application Ser. No. 60/395,471, filed Jul. 12, 2002, the disclosures of which are incorporated herein by reference in their entirety for all purposes.

FIELD OF THE INVENTION

The invention relates to releasing gas into molten metal and more particularly, to a device for releasing gas into a stream of molten metal utilizing the flow of the molten metal stream to assist in drawing the gas into the stream. In this manner, the gas may be released at a relatively low pressure as compared to known devices.

BACKGROUND OF THE INVENTION

As used herein, the term "molten metal" means any metal or combination of metals in liquid form, such as aluminum, copper, iron, zinc and alloys thereof. The term "gas" means any gas or combination of gases, including argon, nitrogen, chlorine, fluorine, freon, and helium, which are released into molten metal.

Known pumps for pumping molten metal (also called "molten-metal pumps") include a pump base (also called a housing or casing), one or more inlets, an inlet being an opening to allow molten metal to enter a pump chamber (and is usually an opening in the pump base that communicates with the pump chamber), a pump chamber, which is an open area formed within the pump base, and a discharge, which is a channel or conduit communicating with the pump chamber (in an axial pump the pump chamber and discharge may be the same structure or different areas of the same structure) leading from the pump chamber to the molten metal bath in which the pump base is submerged. A rotor, also called an impeller, is mounted in the pump chamber and is connected to a drive shaft. The drive shaft is typically a motor shaft coupled to a rotor shaft, wherein the motor shaft has two ends, one end being connected to a motor and the other end being coupled to the rotor shaft. The rotor shaft also has two ends, wherein one end is coupled to the motor shaft and the other end is connected to the rotor. Often, the rotor shaft is comprised of graphite, the motor shaft is comprised of steel, and the two are coupled by a coupling, which is usually comprised of steel.

As the motor turns the drive shaft, the drive shaft turns the rotor and the rotor pushes molten metal out of the pump chamber, through the discharge, which may be an axial or tangential discharge, and into the molten metal bath. Most molten metal pumps are gravity fed, wherein gravity forces molten metal through the inlet and into the pump chamber as the rotor pushes molten metal out of the pump chamber.

Molten metal pump casings and rotors usually employ a bearing system comprising ceramic rings wherein there are one or more rings on the rotor that align with rings in the pump chamber (such as rings at the inlet (which is usually the top of the pump chamber and bottom of the pump chamber) when the rotor is placed in the pump chamber. The purpose of the bearing system is to reduce damage to the soft, graphite components, particularly the rotor and pump chamber wall, during pump operation. A known bearing system is described in U.S. Pat. No. 5,203,681 to Cooper, the disclosure of which is incorporated herein by reference. As discussed in U.S. Pat. Nos. 5,591,243 and 6,093,000, each to Cooper, the disclosures of which are incorporated herein by reference, bearing rings can cause various operational and shipping problems and U.S. Pat. No. 6,093,000 discloses rigid coupling designs and a monolithic rotor to help alleviate this problem. Further, U.S. Pat. No. 2,948,524 to Sweeney et al., U.S. Pat. No. 4,169,584 to Mangalick, U.S. Pat. No. 5,203,681 to Cooper and U.S. Pat. No. 6,123,523 to Cooper (the disclosures of the afore-mentioned patents to Cooper are incorporated herein by reference) all disclose molten metal pumps. Furthermore, copending U.S. patent application Ser. No. 10/773,102 to Cooper, filed on Feb. 4, 2004 and entitled "Pump With Rotating Inlet" discloses, among other things, a pump having an inlet and rotor structure (or other displacement structure) that rotate together as the pump operates in order to alleviate jamming. The disclosure of this copending application is incorporated herein by reference.

The materials forming the components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon) or carbon-based material, excluding graphite, capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Most often, circulation pumps are used in a reverbatory furnace having an external well. The well is usually an extension of a charging well where scrap metal is charged (i.e., added).

Transfer pumps are generally used to transfer molten metal from the external well of a reverbatory furnace to a different location such as a ladle or another furnace. Examples of transfer pumps are disclosed in U.S. Pat. No. 6,345,964 B1 to Cooper, the disclosure of which is incorporated herein by reference, and U.S. Pat. No. 5,203,681.

Gas-release pumps, such as gas-injection pumps, circulate molten metal while releasing a gas into the molten metal. In the purification of molten metals, particularly aluminum, it is frequently desired to remove dissolved gases such as hydrogen, or dissolved metals, such as magnesium, from the molten metal. As is known by those skilled in the art, the removing of dissolved gas is known as "degassing" while the removal of magnesium is known as "demagging." Gas-release pumps may be used for either of these purposes or for any other application for which it is desirable to introduce gas into molten metal. Gas-release pumps generally include a gas-transfer conduit having a first end that is connected to a gas source and a second submerged in the molten metal bath. Gas is introduced into the first end and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where it enters the pump chamber. A system for releasing gas into a pump chamber is disclosed in U.S. Pat. No. 6,123,523 to Cooper.

The advantage of a system for releasing gas into molten metal within the confines of a metal-transfer conduit is that the gas and metal should have a better opportunity to thoroughly interact. One problem with releasing gas into a metal-transfer conduit is that, in some systems, the conduit that transfers the gas from a gas source into the molten metal stream (called a gas-transfer conduit) typically extends into the metal-transfer conduit, usually extending downward from the top of the metal-transfer conduit, and disrupts the flow of molten metal passing through the conduit thereby creating a low-pressure area behind the portion of the gas-transfer conduit extending into the metal-transfer conduit. The low-pressure area can interfere with the released gas mixing with molten metal passing through the metal-transfer conduit because, among other things, the gas immediately rises into the low-pressure area instead of mixing with molten metal throughout the metal-transfer conduit. This can create a phenomenon known as "burping" because large gas bubbles build up in the low pressure area and are released from the discharge instead of thoroughly mixing with the molten metal.

One problem with releasing gas into a molten metal stream outside of a pump casing or metal-transfer conduit connected to the pump casing is that one or more of the components used to transfer the gas into the molten metal may be susceptible to breakage since they are not typically as well supported as if they had been inserted into the pump base or a metal-transfer conduit extending from the base. Another problem is that if the gas is released and is not constrained within a metal-transfer conduit, this may lessen the interaction between the gas and the molten metal.

A problem with known systems, regardless of whether they release gas into or outside of a pump casing or metal-transfer conduit connected to the pump casing is that the gas must be pumped into the molten metal at a relatively high pressure. The high pressure can cause damage to the components through which the gas passes.

SUMMARY OF THE INVENTION

The invention includes a pump and components that enable gas to be released at a relatively low pressure into molten metal passing through a metal-transfer conduit. As used in the context of describing and claiming the invention, unless specifically stated otherwise, the term metal-transfer conduit refers to a pump discharge, a metal-transfer conduit attached to the pump discharge or any conduit through which a stream of molten metal flows. The metal-transfer conduit may be either totally enclosed or partially enclosed. The metal-transfer conduit has at least two sections, a first section having a first cross-sectional area and a second section having a second cross-sectional area. The first cross-sectional area is upstream of and smaller than the second cross-sectional area. A gas-release opening is positioned in the second section, preferably near the first section, or is positioned in the first section, preferably near the second section.

As molten metal moves through the metal-transfer conduit from the first section to the second section, its velocity slows when it enters the second section because of the larger cross-sectional area. Gas is released in either the first section or the second section through a gas-release opening into the molten metal stream and the molten metal stream tends to help draw the gas out of the gas-release opening and into the molten metal stream. This reduces the amount of pressure required to force gas out of the gas-release opening and into the molten metal stream, thereby reducing the stress and wear on components caused by higher pressures and increasing component life.

DETAILED DESCRIPTION OF A PREFERRED EMBODIMENT

Figure 1:
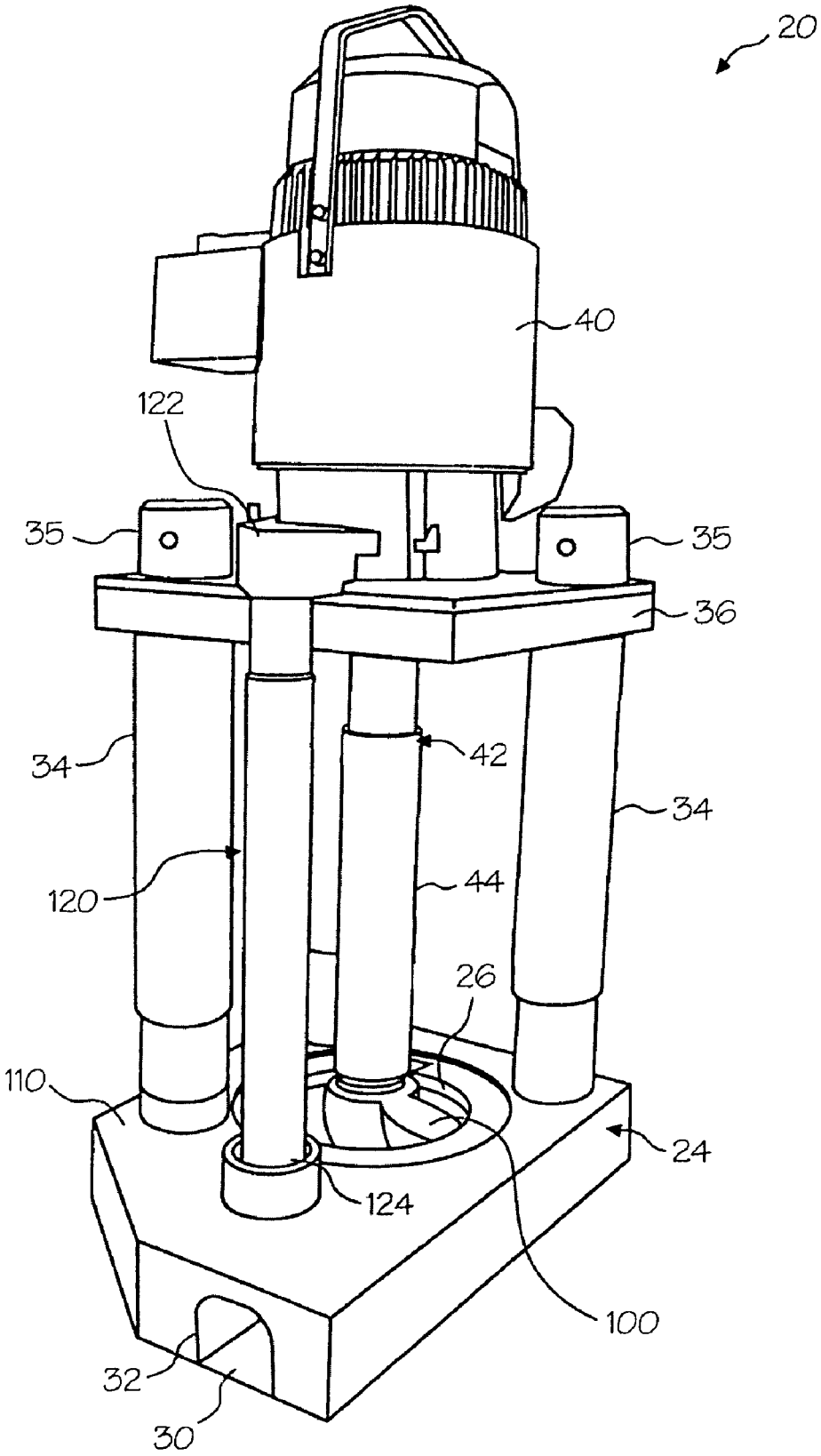
FIG. 1 is a perspective view of a pump for pumping molten metal, which includes a pump base according to the invention.

Referring now to the drawing where the purpose is to illustrate and describe different embodiments of the invention, and not to limit same, FIG. 1 shows a molten metal pump 20 that includes a device 100 in accordance with the present invention. When in operation, pump 20 is usually positioned in a molten metal bath in a pump well, which is usually part of the open well of a reverbatory furnace.

The components of pump 20, including device 100, that are exposed to the molten metal are preferably formed of structural refractory materials, which are resistant to degradation in the molten metal. Carbonaceous refractory materials, such as carbon of a dense or structural type, including graphite, graphitized carbon, clay-bonded graphite, carbon-bonded graphite, or the like have all been found to be most suitable because of cost and ease of machining. Such components may be made by mixing ground graphite with a fine clay binder, forming the non-coated component and baking, and may be glazed or unglazed. In addition, components made of carbonaceous refractory materials may be treated with one or more chemicals to make the components more resistant to oxidation. Oxidation and erosion treatments for graphite parts are practiced commercially, and graphite so treated can be obtained from sources known to those skilled in the art.

Pump 20 can be any structure or device for pumping or otherwise conveying molten metal, such as the pump disclosed in U.S. Pat. No. 5,203,681 to Cooper, or an axial pump having an axial, rather than tangential, discharge. Preferred pump 20 has a pump base 24 for being submersed in a molten metal bath. Pump base 24 preferably includes a generally nonvolute pump chamber 26, such as a cylindrical pump chamber or what has been called a "cut" volute, although pump base 24 may have any shape pump chamber suitable of being used, including a volute-shaped chamber. Chamber 26 may be constructed to have only one opening, either in its top or bottom, if a tangential discharge is used, since only one opening is required to introduce molten metal into pump chamber 26. Generally, pump chamber 24 has two coaxial openings of the same diameter and usually one is blocked by a flow blocking plate mounted on the bottom of, or formed as part of, device 100. As shown, chamber 26 includes a top opening 28, bottom opening 29, and wall 31. Base 24 further includes a tangential discharge 30 (although another type of discharge, such as an axial discharge may be used) in fluid communication with chamber 26. Base 24 has sides 112, 114, 116, 118 and 120 and a top surface 110. The top portion of wall 31 is machined to receive a bearing surface, which is not yet mounted to wall 31 in this figure. The bearing surface is typically comprised of ceramic and cemented to wall 31.

Figure 2:
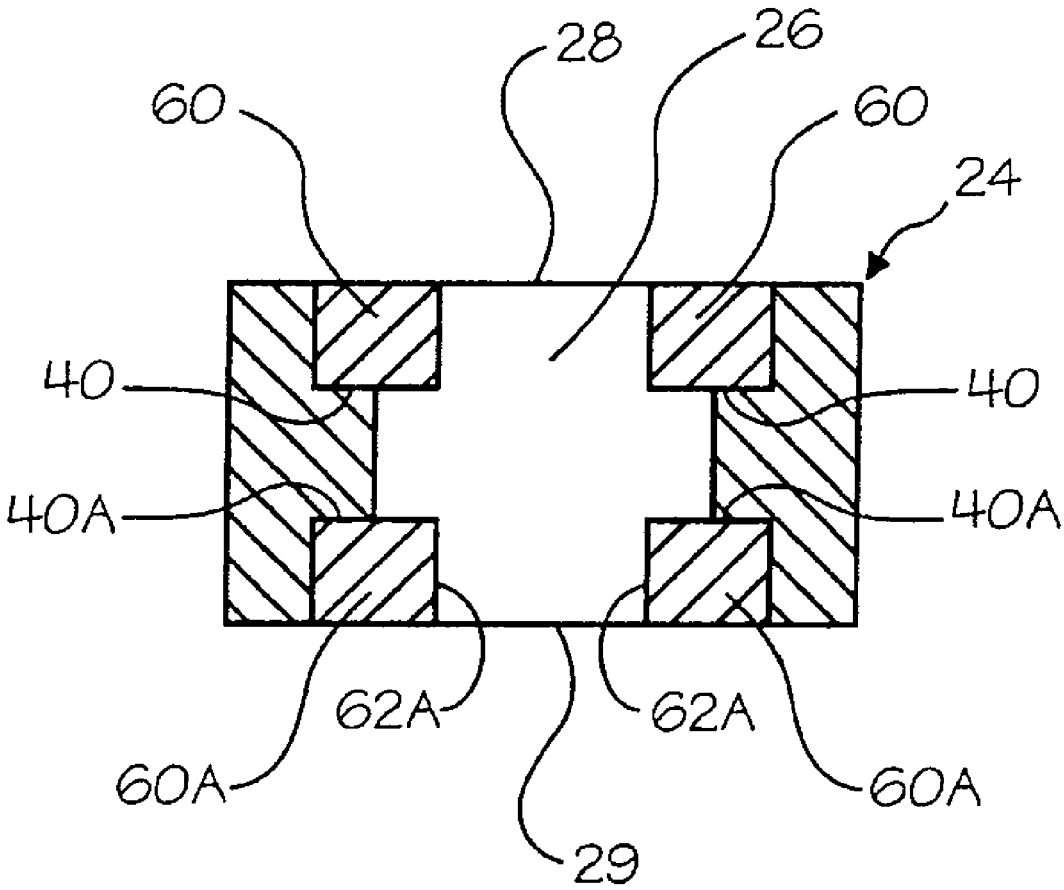
FIG. 2 is a cross-sectional view of the pump base of FIG. 1.
Figure 2A:
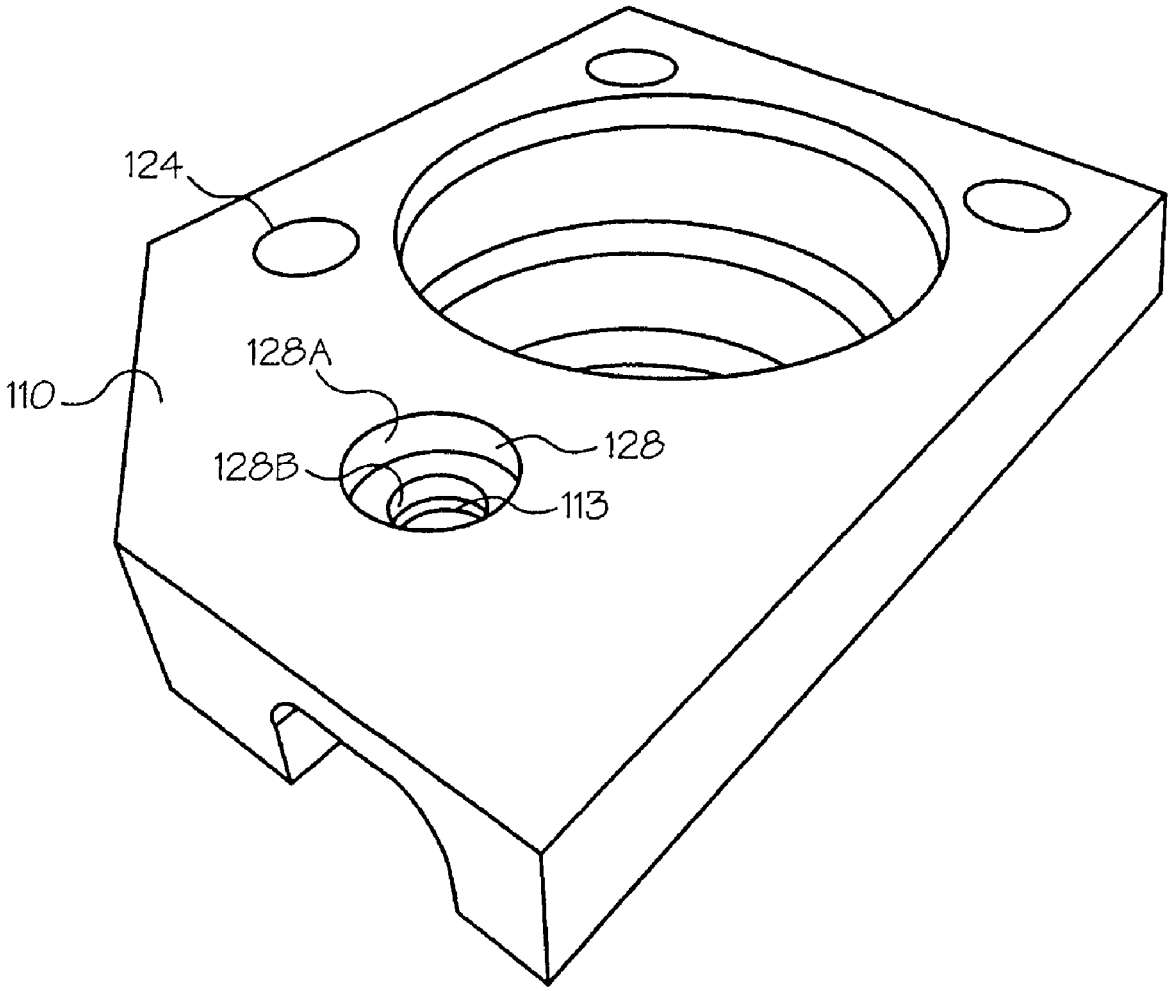
FIG. 2*a* is a side, perspective view of a pump base that can be used in the practice of the invention.
Figure 3:
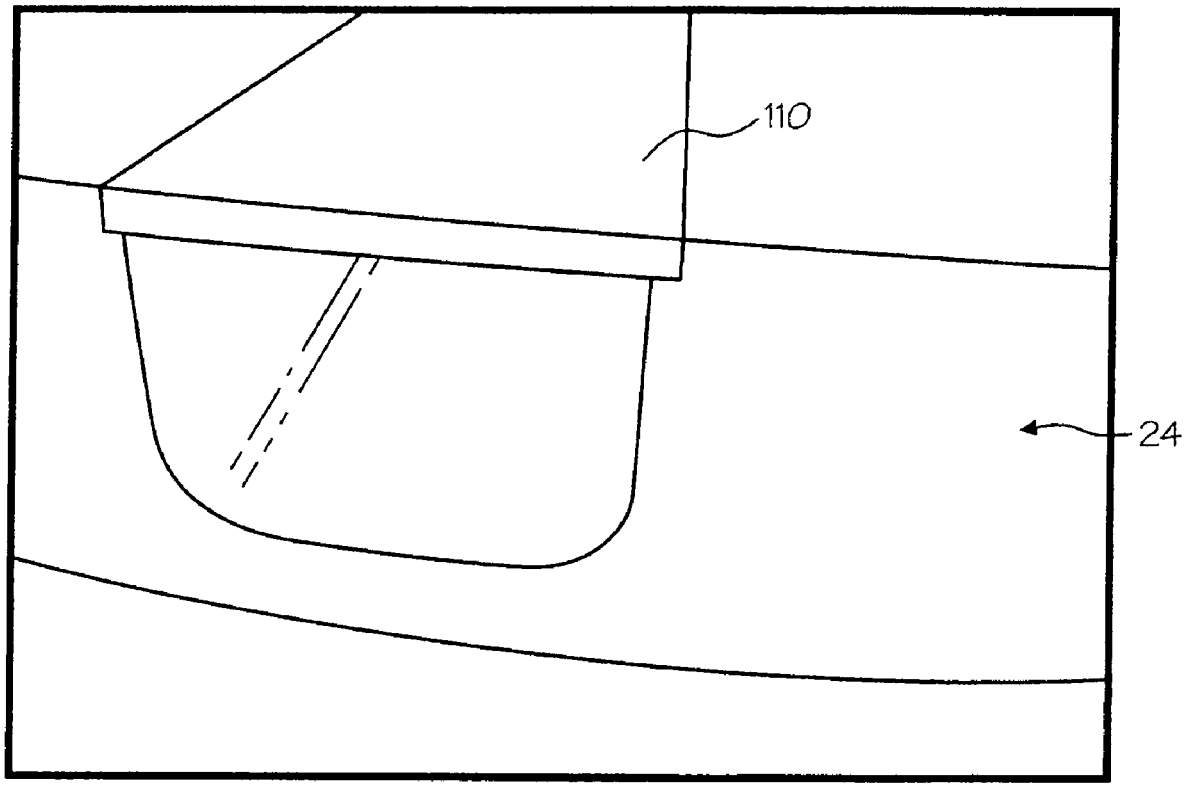
FIG. 3 is a view of the discharge of the pump base of FIG. 2*a*.
Figure 4:
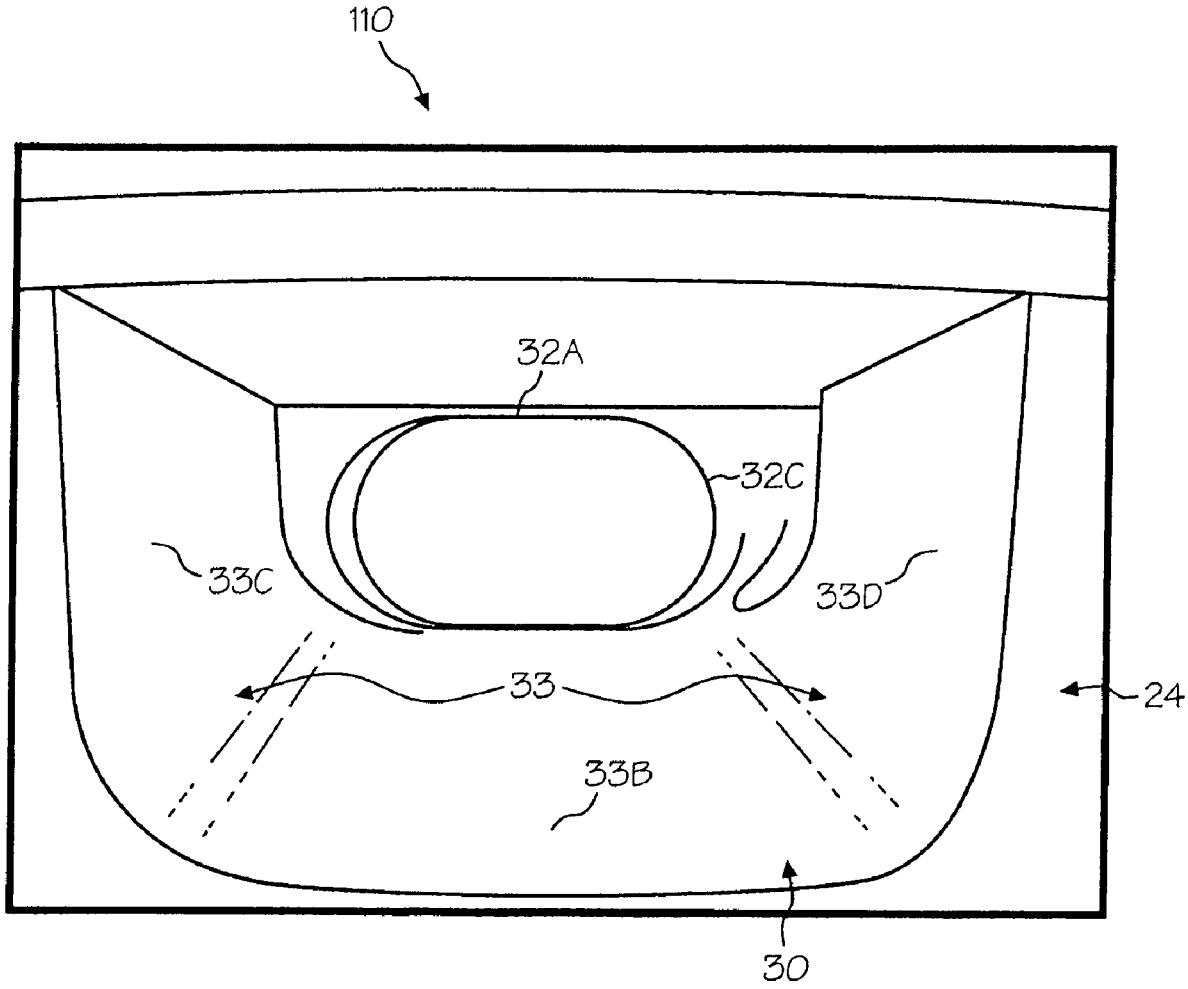
FIG. 4 is an internal view of the discharge of the pump base of FIG. 3.
Figure 5:
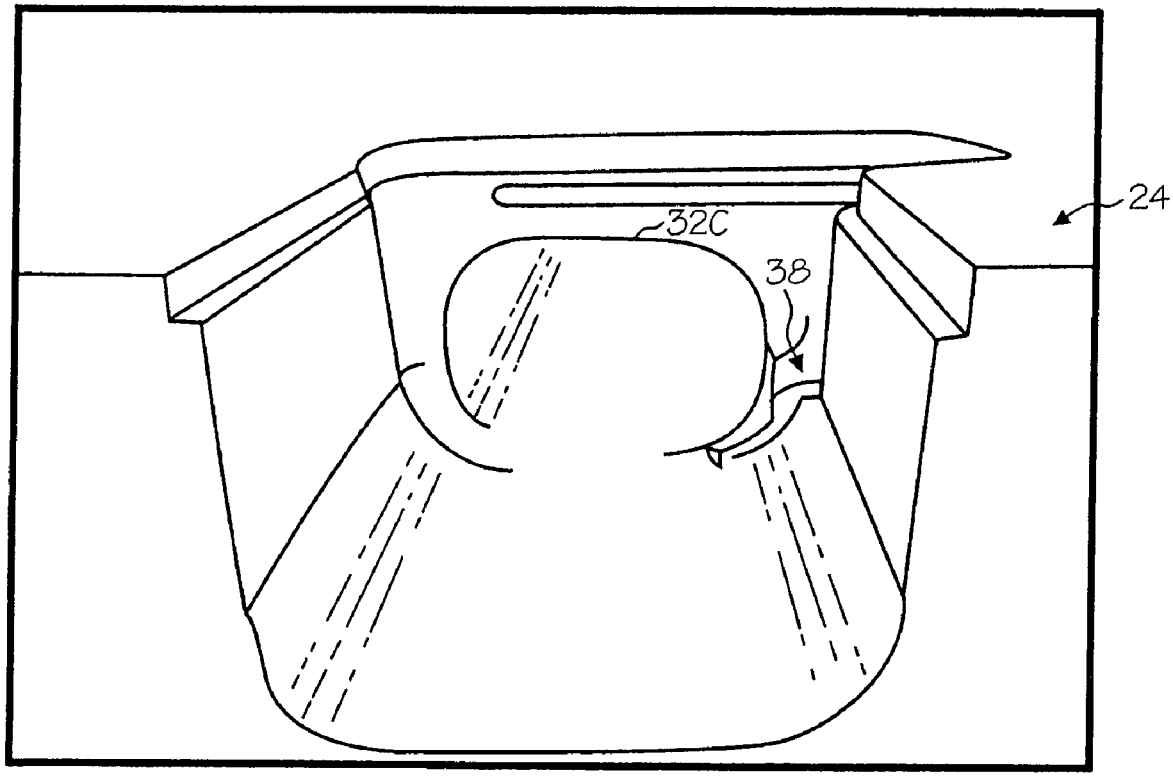
FIG. 5 is the discharge of FIG. 4 with the top surface removed.
Figure 6:
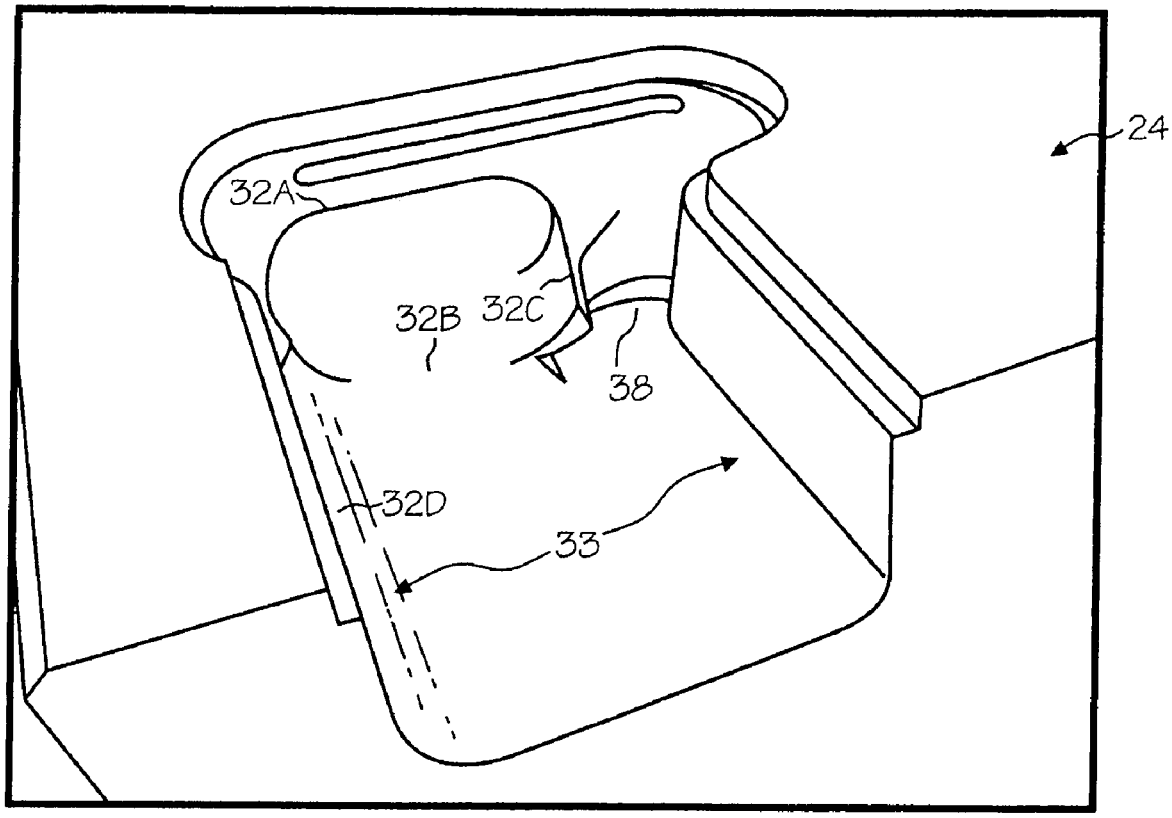
FIG. 6 is another view of the discharge of FIG. 5.
Figure 7:
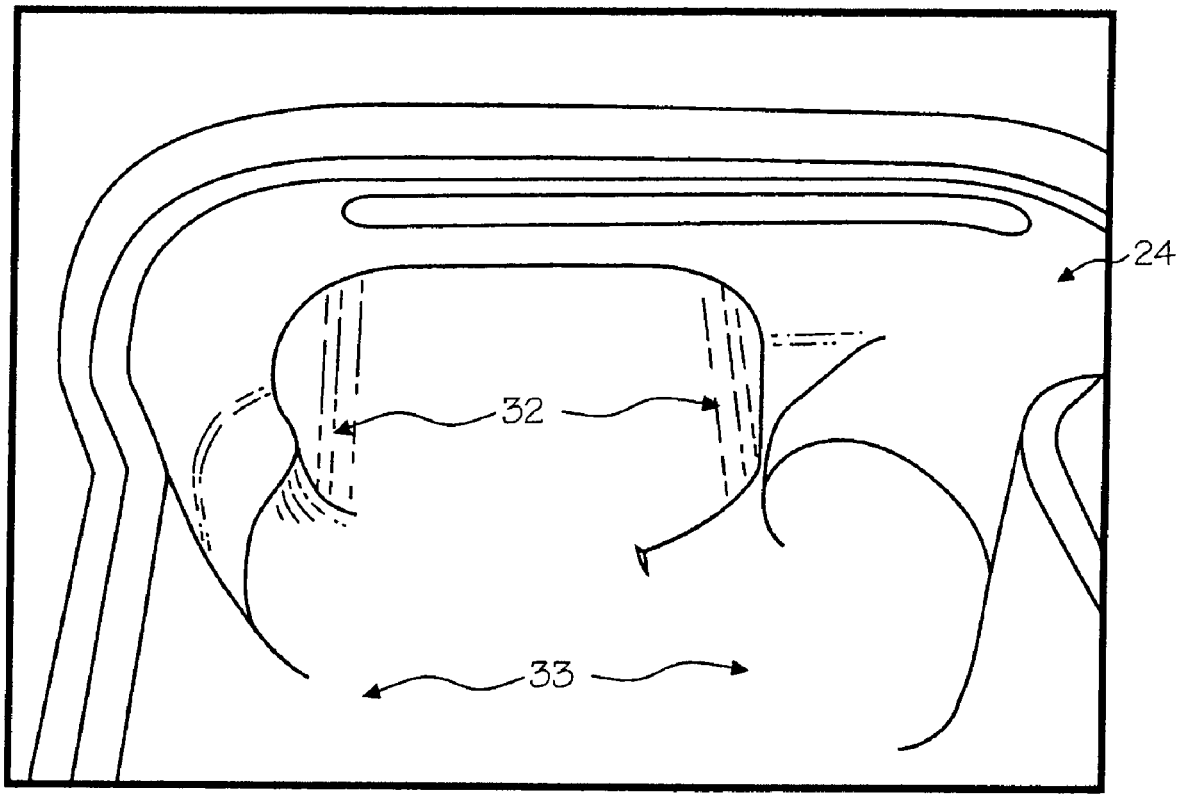
FIG. 7 is a close up view of the discharge of FIG. 5.

As shown in FIG. 2, pump base 24 can have a stepped surface 40 defined at the periphery of chamber 26 at inlet 28 and a stepped surface 40A defined at the periphery of inlet 29, although one stepped surface would suffice. Stepped surface 40 preferably receives a bearing ring member 60 and stepped surface 40A preferably received a bearing ring member 60A. Each bearing member 60, 60A is preferably comprised of silicon carbide. The outer diameter of members 60, 60A varies with the size of the pump, as will be understood by those skilled in the art. Bearing members 60, 60A each has a preferred thickness of 1". Preferably, bearing ring member 60, is provided at inlet 28 and bearing ring member 60A is provided at inlet 29, respectively, of casing 24. In the preferred embodiment, bottom bearing ring member 60A includes an inner perimeter, or first bearing surface, 62A, that aligns with a second bearing surface and guides rotor 100 as described herein. Alternatively, bearing ring members 60, 60A need not be used. For example, FIG. 2A shows a pump casing 24' that is preferably formed entirely of graphite, and that may have a protective coating according to the invention.

One or more support posts 34 connect base 24 to a superstructure 36 of pump 20 thus supporting superstructure 36, although any structure or structures capable of supporting superstructure 36 may be used. Additionally, pump 20 could be constructed so there is no physical connection between the base and the superstructure, wherein the superstructure is independently supported. The motor, drive shaft and rotor could be suspended without a superstructure, wherein they are supported, directly or indirectly, to a structure independent of the pump base.

In the preferred embodiment, post clamps 35 secure posts 34 to superstructure 36. A preferred post clamp and preferred support posts are disclosed in a copending application entitled "Support Post System For Molten Metal Pump," invented by Paul V. Cooper, and filed on Feb. 4, 2004, the disclosure of which is incorporated herein by reference. However, any system or device for securing posts to superstructure 36 may be used.

A motor 40, which can be any structure, system or device suitable for driving pump 20, but is preferably an electric or pneumatic motor, is positioned on superstructure 36 and is connected to an end of a drive shaft 42. A drive shaft 42 can be any structure suitable for rotating an impeller, and preferably comprises a motor shaft (not shown) coupled to a rotor shaft. The motor shaft has a first end and a second end, wherein the first end of the motor shaft connects to motor 40 and the second end of the motor shaft connects to the coupling. Rotor shaft 44 has a first end and a second end, wherein the first end is connected to the coupling and the second end is connected to device 100 or to an impeller according to the invention. A preferred coupling, rotor shaft and connection between the rotor shaft and device 100 are disclosed in a copending application entitled "Molten Metal Pump Components," invented by Paul V. Cooper and filed on Feb. 4, 2004, the disclosure of which is incorporated herein by reference.

The preferred device 100 is disclosed in a copending application entitled "Pump with Rotating Inlet," invented by Paul V. Cooper and filed on Feb. 4, 2004, the disclosure of which is incorporated herein by reference. However, structure 100 can be any rotor suitable for use in a molten metal pump and the term "rotor," as used in connection with this invention, means any device or rotor used in a molten metal pump chamber to displace molten metal.

Base 24 has a top surface 110, a first side 112, a second side 114, a third side 116, a fourth side 118, and a fifth side 120. Base 24 further includes one or more (and preferably three) cavities 122, 124 and 126 for receiving support posts 34, and a stepped cavity 128 for receiving an end of a gas-transfer conduit, shown in FIG. 8. Cavities 124 connect base 24 to support posts 34 such that support posts 34 can support superstructure 36, and can help to support the weight of base 24 when pump 10 is removed from a molten metal bath. Any structure suitable for this purpose may be used. Similarly, cavity 128 can be any structure suitable for receiving a corresponding gas-transfer conduit, wherein the gas-transfer conduit is dimensioned to be received in cavity 128. Cavity 128 as shown is stepped with a first bore 128A and second bore 128B. Bore 128B opens into gas-release area 38 (shown in FIGS. 4-7). A button, or support structure generally in the form of a sleeve may be connected to cavity 128 to support a gas-release conduit received in cavity 128.

Discharge 30 is in fluid communication with chamber 26 and has at least two sections wherein at least one section (a first section) has a smaller cross-sectional area than at least one other section (a second section) downstream of said at least one section. Here, a first section 32 has a first cross-sectional area and a second section 33 is downstream of first section 32 and has a second cross-sectional area, as shown in FIGS. 4-7.

Section 32 is preferably about 1" in length, 3" in height and 4½ in width for a pump utilizing a 10" diameter rotor, and has a substantially flat top surface 32A, a substantially flat bottom surface, 32B, a first radiused side surface 32C and a second radiused side surface 32D. Section 32 defines a passage through which molten metal may pass, and any shape or size passage suitable for efficiently conveying molten metal may be used. In fact, section 32 may not even be completely enclosed; for example, it may not have a bottom surface.

Second section 33 is preferably 10" in length (although any suitable length may be utilized) and has a top surface 34A, a bottom surface 33B, a first side surface 33C and second side surface 33D. Section 33 defines a passage through which molten metal passes and any shape or size passage suitable for efficiently conveying molten metal may be used. Section 33 preferably has a height of about 4" and width of about 5½" for a pump utilizing a rotor with a diameter of 10". Section 33 has a height of about 4" and width of about 6½" for a pump utilizing a rotor having a diameter of 16", and preferably has a cross-sectional area between about 110% and 350% larger than the cross-sectional area of section 32. However, all that is necessary for the proper functioning of the invention is that the cross-sectional area of section 33 be sufficiently larger than the area of section 32 to reduce the amount of pressure required for gas to be released into the molten metal stream as compared to the pressure required to release gas into a metal-transfer conduit that has substantially the same cross-sectional area throughout.

Alternatively, discharge 30 or any metal-transfer conduit in accordance with the invention could have multiple cross-sectional areas, as long as there is a transition from a first section with a first cross-sectional area to a second section with a second cross-sectional area, wherein the second section is downstream of the first section and the second cross-sectional area is greater than the first cross-sectional area. It is preferred that there be an abrupt transition from the first section having a first cross-sectional area to a second section having a second, larger cross-sectional area, however, the transition may be somewhat gradual, taking place over a length of up to 6" or more.

A gas-release area 38 is formed in second section 32, preferably within 3" of wall 36. Gas-release area 38 is any size suitable of receiving an end of a gas-transfer conduit 120 and allowing gas from an opening in conduit 120 to be released into discharge 30. As shown, gas-release area 38 is formed in wall 34D, but, if such a gas-release area is used at all, it could be formed anywhere in second section 34, such as in top surface 34A or bottom surface 34B. It is preferred that area 38 be formed outside of the high-pressure flow of the molten metal stream, as shown in FIGS. 4-7, but it can be positioned anywhere suitable for releasing gas into discharge 30. In addition, the gas-release area may be formed in first section 30 near (preferably within 3") second section 32. All that is necessary for the proper functioning of the invention is that there be (1) a first section of a metal-transfer conduit having a first cross-sectional area and a second section of the metal-transfer conduit downstream of the first section, wherein the second section has a second cross-sectional area larger than the first section, and (2) a gas-release opening in the first section and/or the second section, whereby the respective sections are configured and the gas-release openings is positioned so that less pressure is required to release gas into the molten metal than would be required in known metal-transfer conduits that have substantially the same cross-sectional area throughout. Thus, in addition to a gas-release opening beaing formed in the first section or the second section, a gas-release opening could be formed in the first section and another gas-release opening could be formed in the second section, and gas could be released simultaneously into each section, or into one section or the other.

Gas-transfer conduit 120 (shown in FIG. 8), is preferably a cylindrical, graphite tube having a first end 122 and a second end 124 and a passage 126 extending therethrough. Any structure capable of transferring gas from a gas source (not shown) to discharge 30 or a metal-transfer conduit according to the invention may be used however.

Passage 112 is dimensioned to receive end 124 of gas-transfer conduit 120. End 124 of conduit 120 has an opening in passage 126 through which gas is released into discharge 30. It is preferred that the opening in end 124 be positioned about ½-¾ of the way between surface 100 and wall 34B, although it can be positioned in any suitable location to allow for the transfer of gas into discharge 30. Second end 124 is positioned in passage 112 and any method of connection suitable for making the connection in such a way that gas can be transferred to discharge 30 may be used. Further, gas-transfer conduit 120 could be positioned so as to introduce gas at any suitable place in a metal-transfer conduit, such as discharge 30, including the bottom, top and/or either side.

Figure 8:
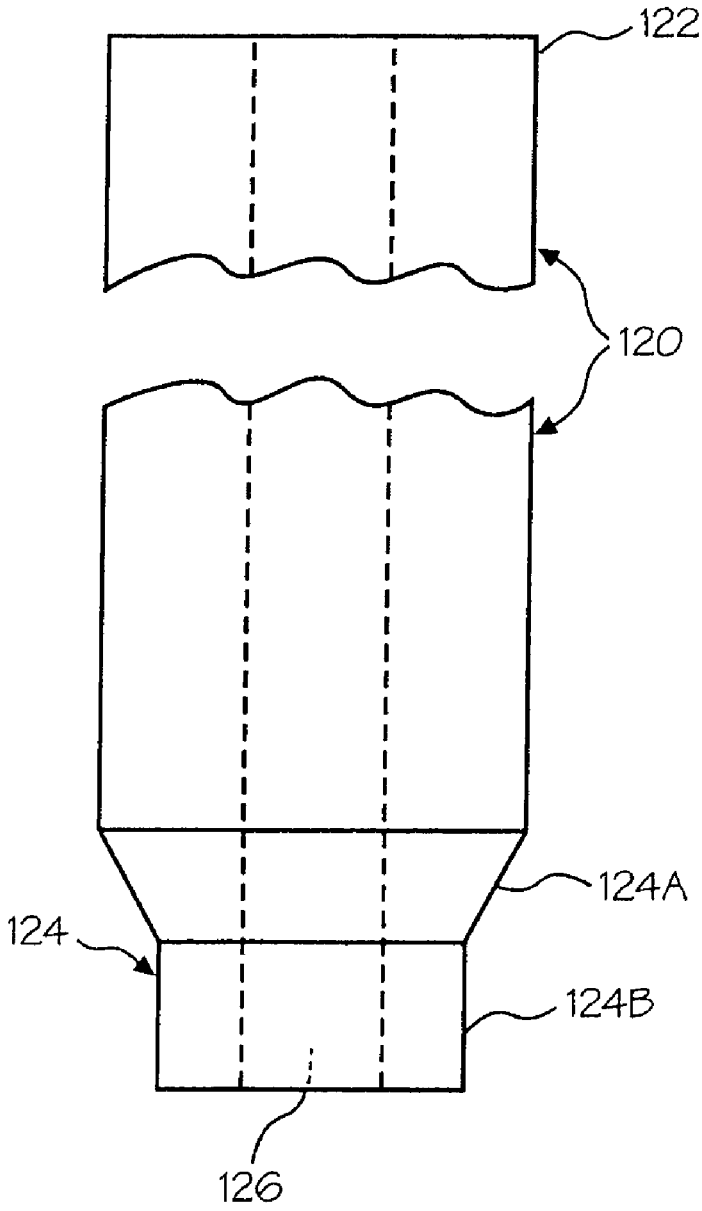
FIG. 8 is a partial side view of a gas-transfer conduit according to the invention.

In one embodiment, and as shown in FIG. 8, end 124 of gas-transfer conduit 120 tapers to a narrow diameter. In this embodiment, conduit 120 tapers in section 124A from a diameter of about 4" to a diameter of about 3" at section 124B and the opening of passage 126 is about 1" in diameter.

Figure 9:
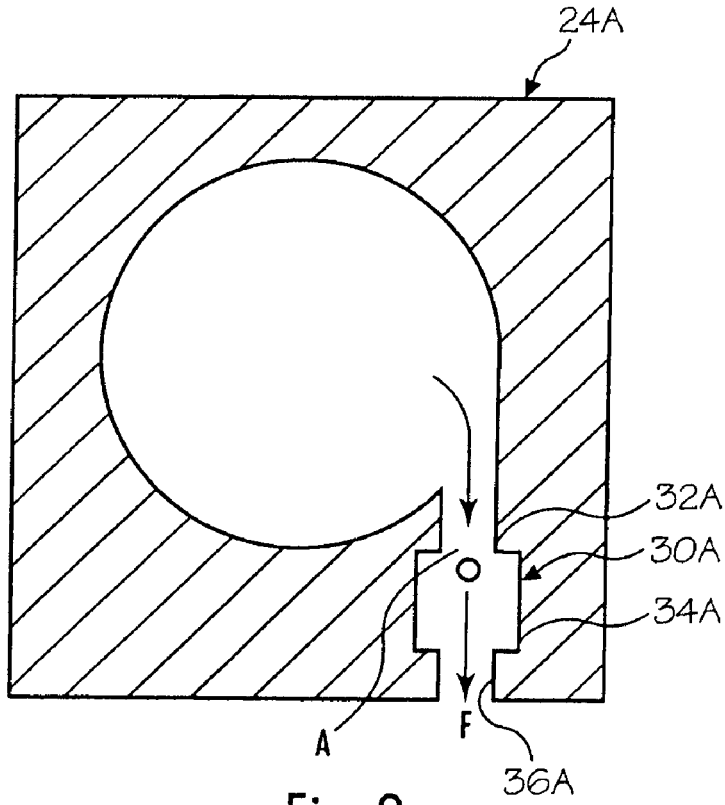
FIG. 9 is a top, cross-sectional view of an alternate pump base according to the invention.
Figure 10:
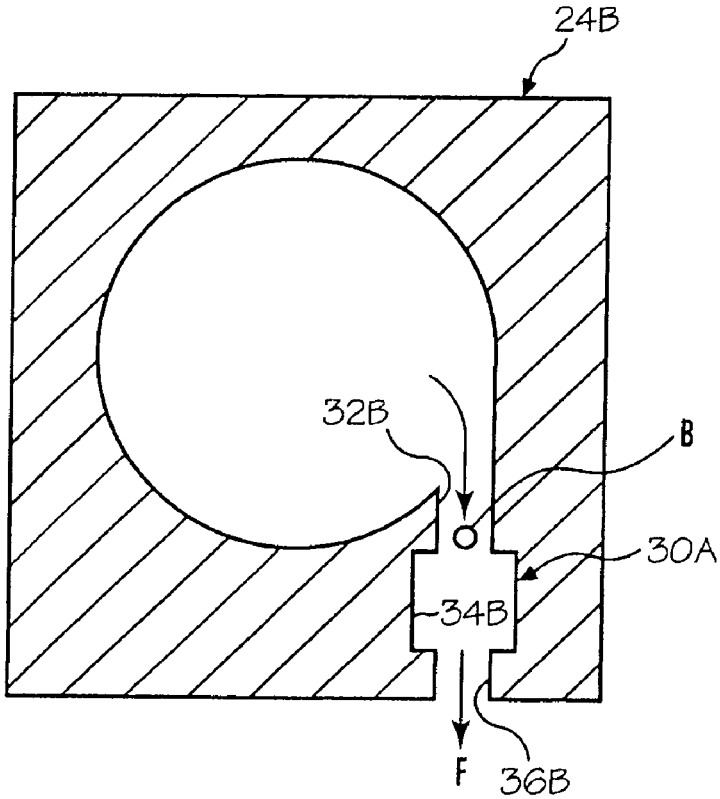
FIG. 10 is the pump base of FIG. 9 with a gas-release opening positioned in the first section of the metal-transfer conduit.

FIG. 9 shows a partial, top view of another embodiment of a pump base and metal-transfer conduit (here, a discharge) according to the invention. In this embodiment, the metal-transfer conduit, or discharge, 30A has a first section 32A having a first cross-sectional area, a second section 34A, which is downstream of section 32A and has a second cross-sectional area that is larger than the first cross-sectional area, and a third section 36A, which is downstream of section 34A and has a third cross-sectional area, wherein the third cross-sectional area is smaller than the second cross-sectional area but preferably larger than the first cross-sectional area. A position A is shown where a gas-release opening would be positioned near a top surface of section 34A, although it could be positioned anywhere in section 32A or section 34A that would allow gas to be released into metal-transfer conduit 30A at a pressure lower than would be required if conduit 30A had a substantially uniform cross-section in the manner of prior art devices. FIG. 10 shows a pump base 24B having the same structure as pump base 24A except that the gas-release opening is at position B in section 32B.

Figure 11:
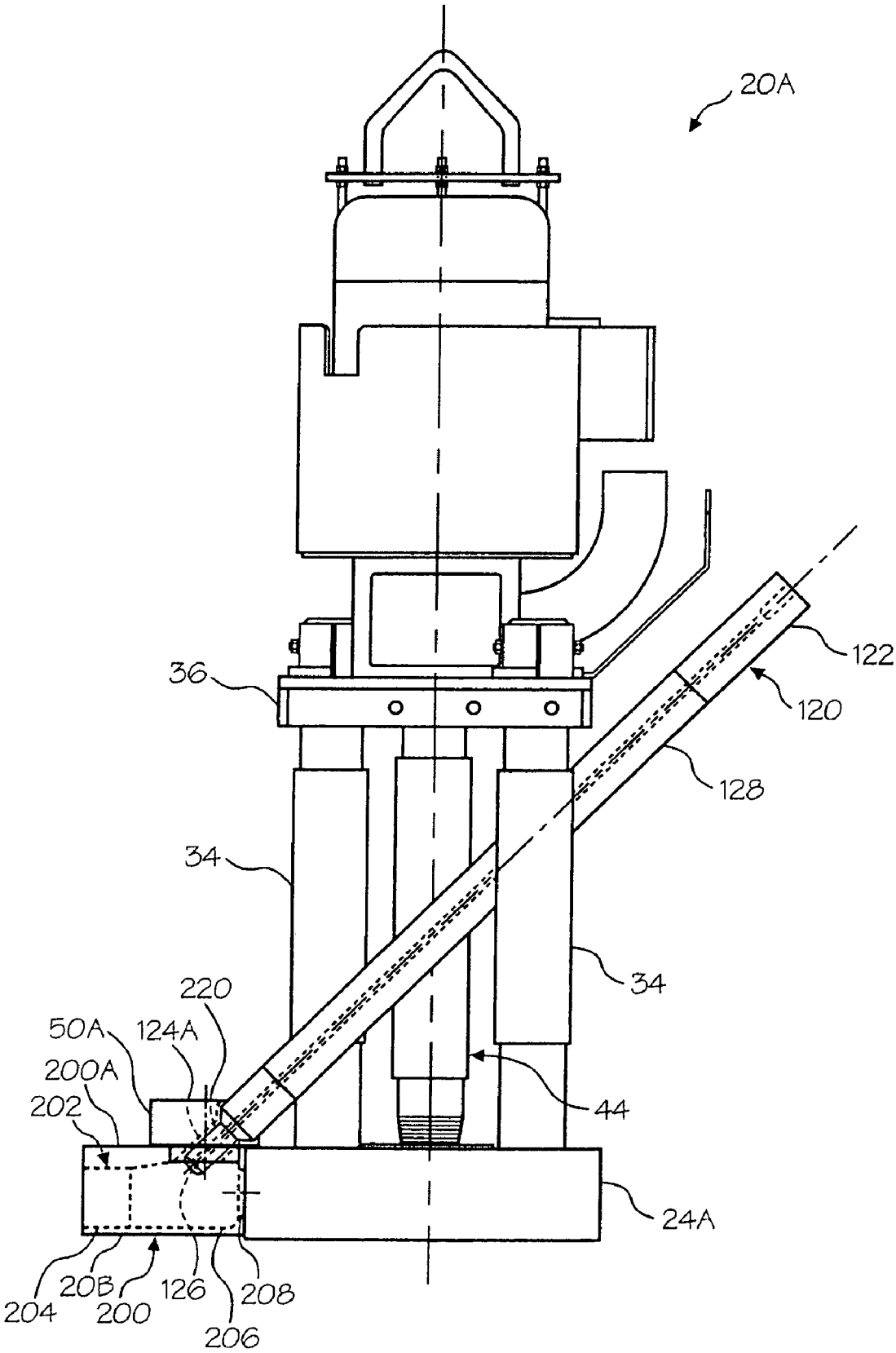
FIG. 11 is a side view of a pump according to the invention with a gas-transfer to be positioned so that the gas-release opening is in the top of the metal-transfer conduit.

FIG. 11 shows an alternate pump 20*a* that is in all respects the same as previously described pump 20 except that pump 20*a* includes a different base 24*a*, a metal-transfer conduit 202 attached to base 24*a* and gas-transfer conduit 120 is mounted at an angle to metal-transfer conduit 202. Base 24*a* is the same as previously described base 24 except that it is smaller and has a shorter discharge (not shown). Alternatively, and as preferred, the base used with pump 20*a* could be configured to include the structure of metal-transfer conduit 202 as part of the discharge in the base.

Metal-transfer conduit 200 has a top surface 200*a* and a bottom surface 200*b*. A passage 202 is formed in conduit 200 and includes sections 204, 206 and 208. First section 208 is upstream of second section 206 and third section 204 and has a first cross-sectional area. Second section 206 is upstream of third section 204 and has a second cross-sectional area that is larger than the first cross-sectional area. Third section 202 has a third cross-sectional area that is preferably (although not necessarily) smaller than the second cross-sectional area, but preferably (although not necessarily) larger than the first cross-sectional area.

Figure 12A:
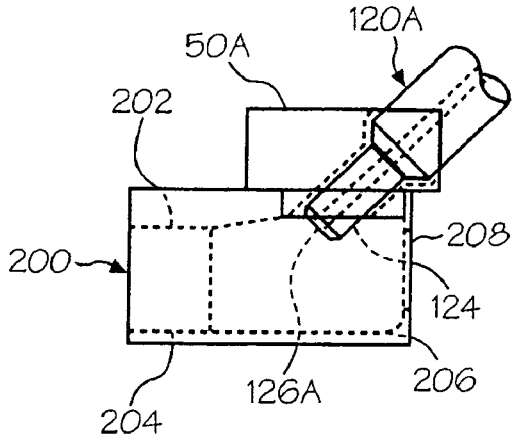
FIG. 12*a* is a partial side view of the gas-transfer conduit positioned in the metal-transfer conduit of FIG. 11.

Gas-transfer conduit 120 is mounted at an angle such that end 124 extends through opening 220 and gas-release opening 126 is positioned near the top of section 206. End 124 is mounted to button 50*a* to assist in retaining it (button 50*a* being a generally cylindrical sleeve affixed above an opening leading to the interior of conduit 220). FIG. 12*a* shows conduit 120 mounted in metal-transfer conduit 220.

Figure 12B:
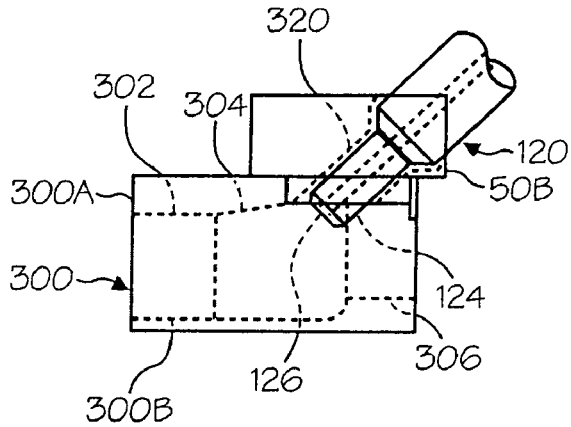
FIG. 12*b* is a partial side view of a gas-transfer conduit positioned in a metal-transfer at a location other than the one shown in FIG. 12*a*.

FIG. 12*b* shows a metal-transfer conduit 300 having gas-transfer conduit 120 mounted therein. Metal-transfer conduit 300 has a top surface 300*a* and a bottom surface 300*b*. A passage 302 is formed in conduit 300 and includes sections 304, 306 and 308. First section 308 is upstream of second section 306 and third section 304 and has a first cross-sectional area. Second section 306 is upstream of third section 304 and has a second cross-sectional area that is larger than the first cross-sectional area. Third section 302 has a third cross-sectional area that is preferably (although not necessarily) smaller than the second cross-sectional area, but preferably (although not necessarily) larger than the first cross-sectional area.

Figure 12C:
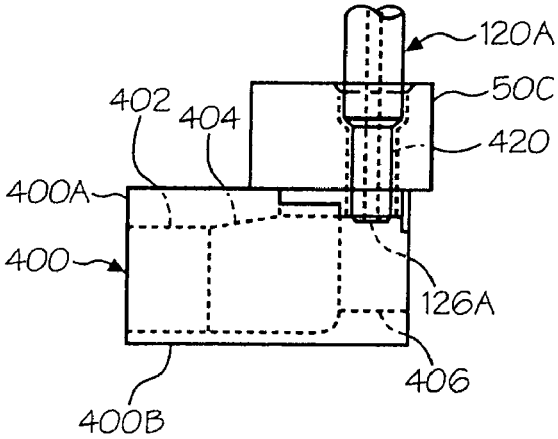
FIG. 12*c* is a partial side view of a gas-transfer conduit positioned at a location other than the ones shown in FIGS. 12*a* and 12*b*.

FIG. 12*c* shows a metal-transfer conduit 400 having conduit 120 mounted therein. Metal-transfer conduit 400 has a top surface 400*a* and a bottom surface 400*b*. A passage 402 is formed in conduit 400 and includes sections 404, 406 and 408. First section 408 is upstream of second section 406 and third section 404 and has a first cross-sectional area. Second section 406 is upstream of third section 404 and has a second cross-sectional area that is larger than the first cross-sectional area. Third section 402 has a third cross-sectional area that is preferably (although not necessarily) smaller than the second cross-sectional area, but preferably (although not necessarily) larger than the first cross-sectional area.

Figure 12D:
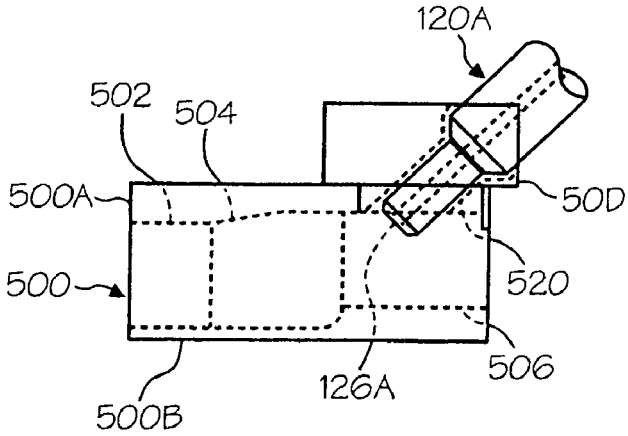
FIG. 12*d* is a partial side view of a gas-transfer conduit positioned at a location other than the ones shown in FIGS. 12*a*-12*c*.

FIG. 12*d* shows a metal-transfer conduit 500 having a gas-transfer conduit 120 mounted therein. Metal-transfer conduit 500 has a top surface 500*a* and a bottom surface 500*b*. A passage 502 is formed in conduit 500 and includes sections 504, 506 and 508. First section 508 is upstream of second section 506 and third section 504 and has a first cross-sectional area. Second section 506 is upstream of third section 504 and has a second cross-sectional area that is larger than the first cross-sectional area. Third section 502 has a third cross-sectional area that is preferably (although not necessarily) smaller than the second cross-sectional area, but preferably (although not necessarily) larger than the first cross-sectional area.

Referring again to FIGS. 1-8, in operation, gas is transferred through gas-transfer tube 120 to opening 126 where it is released into discharge 30. As molten metal travels through discharge 30 and moves from section 32 to section 34, its velocity slows and it is presumed that the pressure of the molten metal stream increases (although the invention is not limited to any particular theory). This flow of molten metal helps to draw gas out of conduit 120 and into the molten metal stream thereby decreasing the pressure required to push gas through conduit 120. When in operation, as an example for one embodiment, a gas volume of 400 lbs./hr was released into a molten metal stream generated by pump having a 16" diameter rotor operating in the 300 revolutions-per-minute range.

In addition to the metal-transfer conduit being a pump base discharge as described above, it could be a separate piece connected to a pump base, or simply a separate piece through which a stream of molten metal flows. Furthermore, the gas-transfer conduit, or any other device for transferring gas into a metal-transfer conduit according to the invention, can be positioned anywhere suitable for transferring gas into the metal-transfer conduit. For example, it could be positioned beneath the metal-transfer conduit and/or release gas into the bottom of the metal-transfer conduit.

Having thus described different embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired product or result.

What is claimed is:

1. A base for a molten metal pump, the base comprising: a pump chamber; a discharge in communication with the pump chamber, the discharge including a first section having a first cross-sectional area and a second section having a second cross-sectional area, the second section being downstream of the first section and the second cross-sectional area being larger than the first cross-sectional area; and a gas-release opening in communication with one or more of the group consisting of the first section and the second section.

2. The base of claim 1 wherein the gas-release opening is positioned along a side wall of the second section.

3. The base of claim 1 wherein the gas-release opening is positioned near a top wall of the second section.

4. The base of claim 1 wherein the gas-release opening is positioned within 3" of the first section.

5. The base of claim 1 wherein the discharge is fully enclosed.

6. The base of claim 1 wherein the second cross-sectional area is between about 110% and 350% larger than the first cross-sectional area.

7. The base of claim 1 wherein the second cross-sectional area is between about 110% and 120% larger than the first cross-sectional area.

8. The base of claim 1 wherein the second cross-sectional area is between about 120% and 150% larger than the first cross-sectional area.

9. The base of claim 1 wherein the second cross-sectional area is between about 150% and 200% larger than the first cross-sectional area.

10. The base of claim 1 wherein the second cross-sectional area is between about 200% and 300% larger than the first cross-sectional area.

11. The base of claim 1 wherein the second cross-sectional area is between about 250% and 350% larger than the first cross-sectional area.

12. The base of claim 1 that is comprised of graphite.

13. The base of claim 1 wherein there is a gas-release opening in communication with the first section and a gas-release opening in communication with the second section.

14. A molten metal pump including: a base for a molten metal pump, the base comprising: a pump chamber; a discharge in communication with the pump chamber, the discharge including a first section having a first cross-sectional area and a second section having a second cross-sectional area, the second section being downstream of the first section and the second cross-sectional area being larger than the first cross-sectional area; and a gas-release opening in communication with one or more of the group consisting of the first section and the second section.

15. The molten metal pump of claim 14 that further includes a metal-transfer conduit connected to the discharge.

16. The molten metal pump of claim 14 wherein the gas-release opening is positioned less than 12" from the first section.

17. The molten metal pump of claim 14 wherein the gas-release opening is positioned within 3" of the first section.

18. The molten metal pump of claim 14 wherein the discharge is fully enclosed.

19. The molten metal pump of claim 14 wherein the second cross-sectional area is between about 110% and 350% larger than the first cross-sectional area.

20. The molten metal pump of claim 14 wherein the second cross-sectional area is between about 110% and 120% larger than the first cross-sectional area.

21. The molten metal pump of claim 14 wherein the second cross-sectional area is between about 120% and 150% larger than the first cross-sectional area.

22. The molten metal pump of claim 14 wherein the second cross-sectional area is between about 150% and 200% larger than the first cross-sectional area.

23. The molten metal pump of claim 14 wherein the second cross-sectional area is between about 200% and 300% larger than the first cross-sectional area.

24. The molten metal pump of claim 14 wherein the second cross-sectional area is between about 250% and 350% larger than the first cross-sectional area.

25. The molten metal pump of claim 14 that further includes a device positioned in a pump chamber in the pump base, the device having a displacement structure and an inlet structure defining one or more inlets wherein the displacement structure and the inlet structure rotate as the device rotates.

26. The molten metal pump of claim 25 wherein the gas-release opening is positioned near a top wall of the second section.

27. The base of claim 1 wherein the third cross-sectional area is larger than the first cross-sectional area.

28. The molten metal pump of claim 14 wherein the third cross-sectional area is larger than the first cross-sectional area.

* * * * *